US006266500B1

(12) United States Patent
Numagami et al.

(10) Patent No.: US 6,266,500 B1
(45) **Date of Patent: *Jul. 24, 2001**

(54) DEVELOPING APPARATUS AND PROCESS CARTRIDGE

(75) Inventors: Atsushi Numagami, Hadano; Toshiyuki Karakama, Shizuoka-ken; Toru Oguma, Mishima, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/188,317

(22) Filed: Nov. 10, 1998

(30) Foreign Application Priority Data

Nov. 11, 1997 (JP) ..... 9-325410

(51) Int. Cl.[7] ..... G03G 15/08
(52) U.S. Cl. ..... 399/104; 399/103
(58) Field of Search ..... 399/103, 104, 399/119, 274, 284

(56) References Cited

U.S. PATENT DOCUMENTS 4,566,402 * 1/1986 Shimazaki ..... 399/284
4,579,081 * 4/1986 Kohyama ..... 399/119

(List continued on next page.)

FOREIGN PATENT DOCUMENTS 30 06 742 A1 9/1980 (DE) .
789 286 A2 8/1997 (EP) .
9-043981 * 2/1997 (JP) .
9-258560 10/1997 (JP) .

OTHER PUBLICATIONS

Patent Abstracts of Japan, vol. 1998, No. 02, Jan. 30, 1998 (English Abstract of—JP 09–258560).

*Primary Examiner*—Susan S.Y. Lee
(74) *Attorney, Agent, or Firm*—Fitzpatrick, Cella, Harper & Scinto

(57) ABSTRACT

A developing apparatus for developing a latent image formed on an electrophotographic photosensitive member, includes (a) a developer carrying member for feeding a magnetic developer to develop a latent image formed on the electrophotographic photosensitive member with the magnetic developer, wherein a magnet is disposed in the developer carrying member; (b) a magnetic seal member provided at each of one and the other longitudinal ends of the developer carrying member with a clearance from a peripheral surface of the developer carrying member to prevent leakage of the developer in a longitudinal direction of the developer carrying member; (c) a developer regulating member provided contacted to the peripheral surface of the developer carrying member to prevent reentering of the developer having passed through the gap between the developer carrying member and the magnetic seal member.

32 Claims, 16 Drawing Sheets

U.S. PATENT DOCUMENTS

| | | | | |
|---|---|---|---|---|
| 4,792,831 | * | 12/1988 | Takeda et al. | 399/284 X |
| 5,084,733 | * | 1/1992 | Katoh et al. | 399/104 |
| 5,128,716 | * | 7/1992 | Kita | 399/274 X |
| 5,166,733 | | 11/1992 | Eliason . | |
| 5,187,326 | * | 2/1993 | Shirai | 399/104 |
| 5,233,390 | * | 8/1993 | Fujimoto | 399/274 X |
| 5,283,616 | | 2/1994 | Numagami et al. . | |
| 5,303,010 | * | 4/1994 | Takano et al. | 399/284 X |
| 5,488,462 | * | 1/1996 | Ishikawa et al. | 399/103 |
| 5,500,714 | | 3/1996 | Yashiro et al. . | |
| 5,543,898 | | 8/1996 | Shishido et al. . | |
| 5,585,895 | | 12/1996 | Yashiro et al. . | |
| 5,617,579 | | 4/1997 | Yashiro et al. . | |
| 5,623,328 | | 4/1997 | Tsuda et al. . | |
| 5,689,774 | | 11/1997 | Shishido et al. . | |
| 5,749,027 | | 5/1998 | Ikemoto et al. . | |
| 5,768,660 | | 6/1998 | Kurihara et al. . | |
| 5,774,766 | | 6/1998 | Karakama et al. . | |
| 5,790,923 | * | 8/1998 | Oguma et al. . | |
| 5,794,101 | | 8/1998 | Watanabe et al. . | |
| 5,812,909 | * | 9/1998 | Oguma et al. . | |
| 5,828,928 | | 10/1998 | Sasago et al. . | |
| 5,878,310 | | 3/1999 | Noda et al. . | |
| 5,884,124 | | 3/1999 | Karakama et al. . | |
| 5,890,036 | | 3/1999 | Karakama et al. . | |

* cited by examiner

DEVELOPING APPARATUS AND PROCESS CARTRIDGE

FIELD OF THE INVENTION AND RELATED ART

The present invention relates to a developing apparatus and a process cartridge.

In an electrophotographic image forming apparatus using an electrophotographic image forming process, a process cartridge is used, which contains the electrophotographic photosensitive member and process means actable on said electrophotographic photosensitive member, and which is detachably mountable as a unit to a main assembly of the image forming apparatus (process cartridge type). With this process cartridge type, the maintenance of the apparatus can be carried out in effect by the user without depending on a serviceman. Therefore, such a process cartridge type is now widely used in electrophotographic image forming apparatuses.

In such a developing device in a process cartridge, there is provided a seal member for preventing leakage of the developer(toner) out of the developing zone, at each of the opposite ends of the rotatable developer carrying member (developing roller). Conventionally, such a seal member is a elastic member such as felt or rubber foam.

The developing roller contains a fixed magnet roller therein. It is rotatably supported on the developing container through bearings. Therefore, the toner supplied from the toner container is deposited on the surface of the developing roller by the magnetic force provided by the magnet roller. The developing blade regulates the layer thickness of the toner deposited on the peripheral surface of the developing roller. Thereafter, the toner is fed to the electrophotographic photosensitive drum with the rotation of the developing roller. It is deposited onto the latent image formed on photosensitive drum to develop the image. The developing roller is provided with an elastic sealing member at each of the opposite ends thereof. By press-contacting the elastic sealing member to the outer surface of the developing sleeve, the toner is prevented from leaking out.

On the other hand, it has been proposed a developing sleeve is provided with a seal member (magnetic sealing member) of magnetic material with a predetermined gap at each of the opposite ends thereof to prevent the toner from leaking out.

By using the magnetic seal member, the developing roller and the seal member can be out of contact from each other. Accordingly, the rotation torque of the developing roller can be remarkably reduced. Therefore, the driving motor may be downsized and may be less expensive. The variation of the rotation torque is small, and the developing roller and the photosensitive drum can be rotated a uniform speed. Therefore, the deterioration of the image quality attributable to any rotation nonuniformity can be prevented. Also, the wearing can be avoided.

The present invention is directed to a further improvement of such a process cartridge.

SUMMARY OF THE INVENTION

Accordingly, it is a principal object of the present invention to provide a developing device and a process cartridge wherein the leakage of the developer can be prevented.

It is another object of the present invention to provide a developing device and a process cartridge wherein a developer having passed through a gap between a developer carrying member and a magnetic seal member are prevented from reentering the gap.

It is a further object of the present invention to provide a developing device and a process cartridge having a developer regulating member contacted to a peripheral surface of the developer carrying member to prevent the developer having passed through a gap between a developer carrying member and a magnetic seal member from reentering the gap.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Next, desirable embodiments of the present invention will be described. In the following description, the "widthwise"

direction of a process cartridge B means the direction in which the process cartridge B is installed into, or removed from, the main assembly of an image forming apparatus, and coincides with the direction in which a recording medium is conveyed. The "lengthwise" direction of the process cartridge B means a direction which is intersectional with (substantially perpendicular to) the direction in which the process cartridge B is installed into, or removed from, the main assembly 14. It is parallel with the surface of the recording medium, and intersectional with (substantially perpendicular to) the direction in which the recording medium is conveyed. Further, the "left" or "right" means the left or right relative to the direction in which the recording medium is conveyed, as seen from above.

Figure 1:
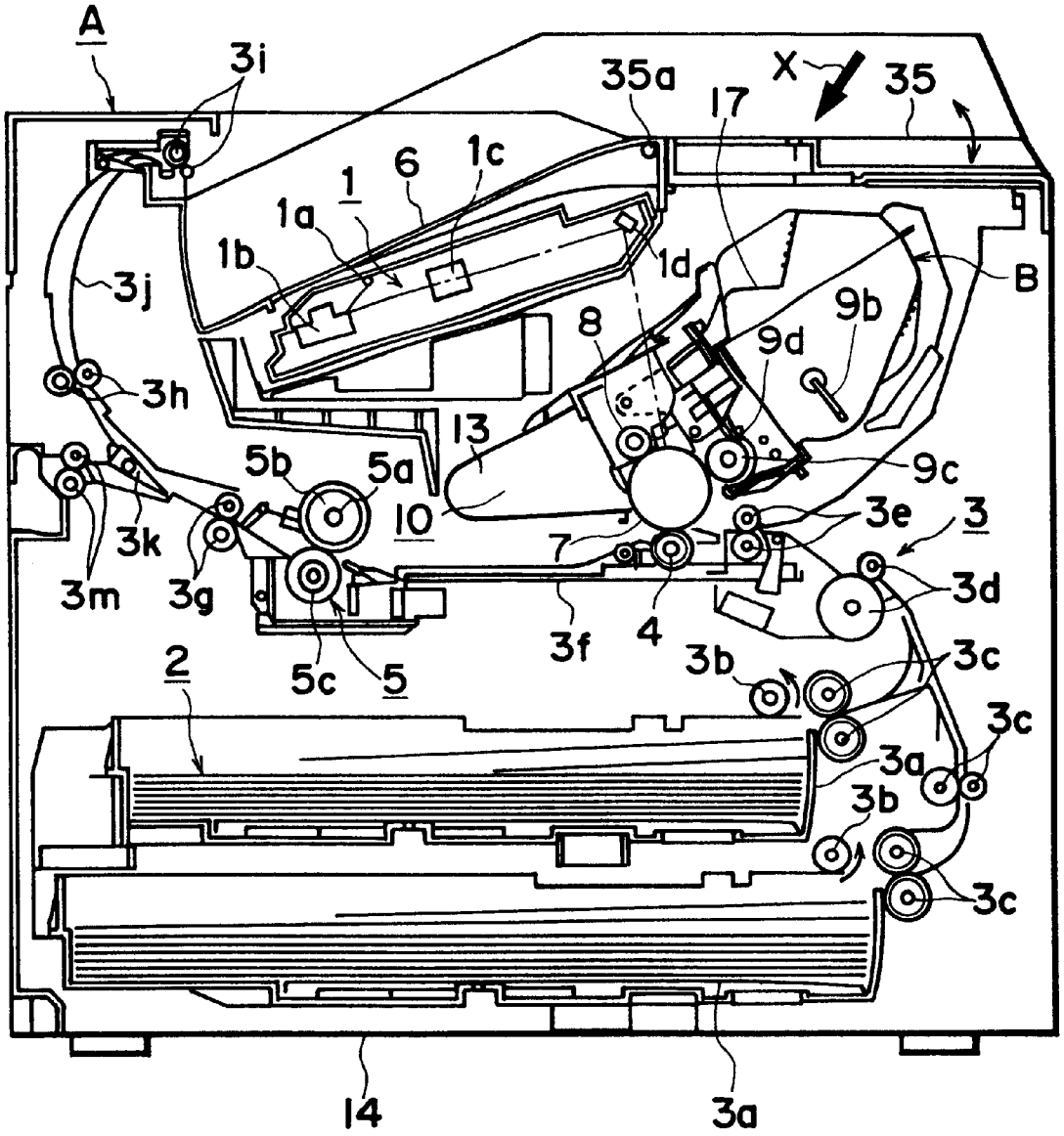
FIG. 1 is a vertical section of an electrophotographic image forming apparatus.
Figure 2:
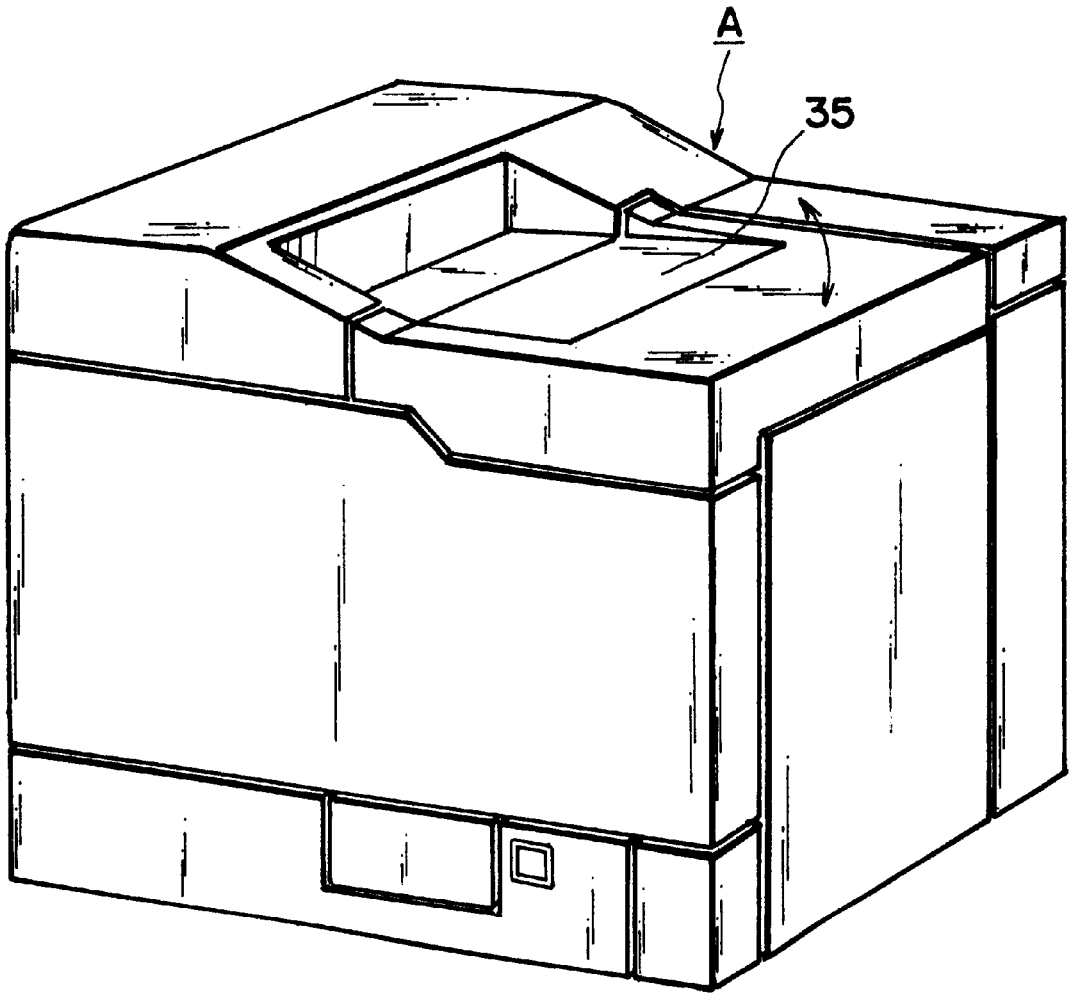
FIG. 2 is an external, perspective view of the apparatus illustrated in FIG. 1.
Figure 3:
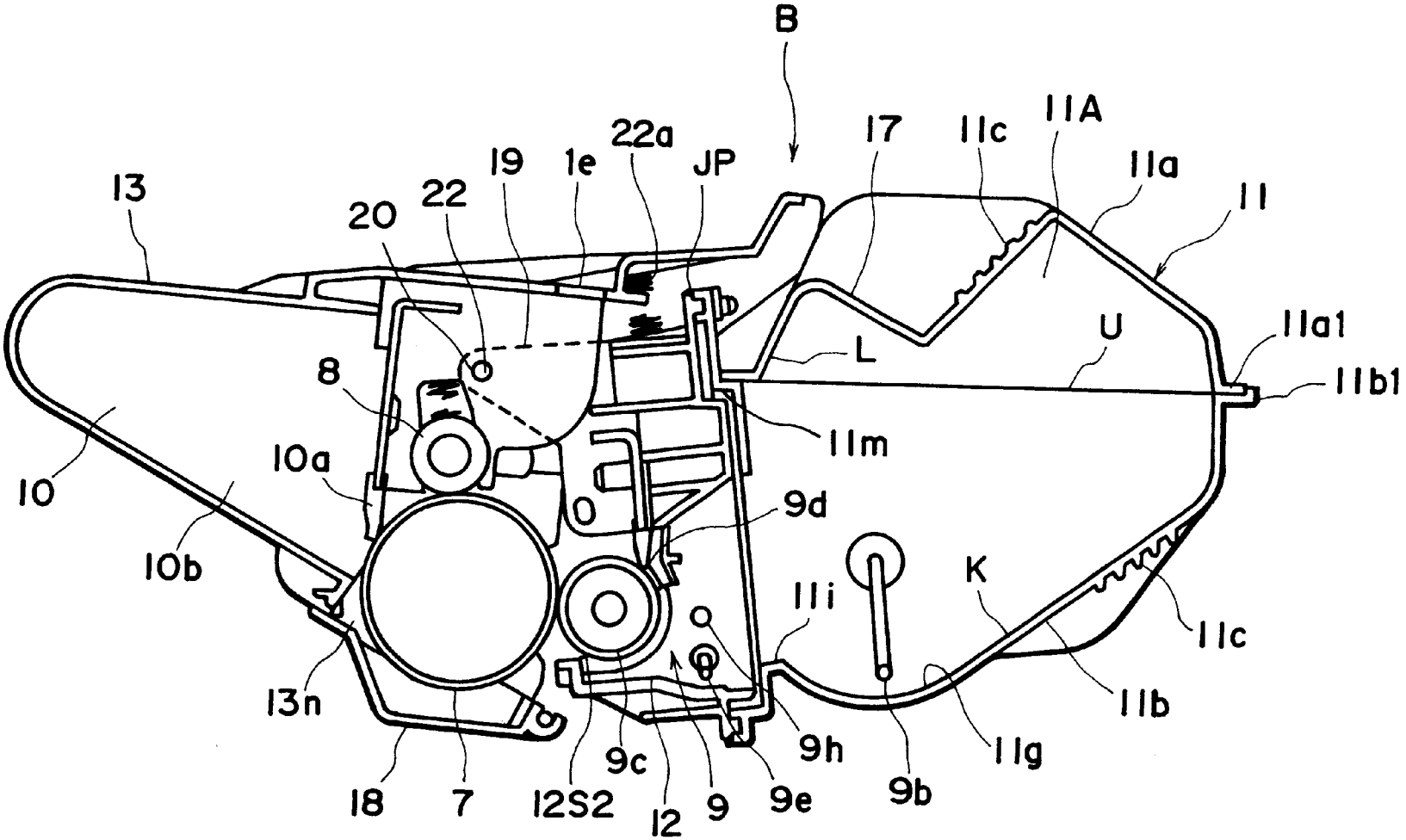
FIG. 3 is a cross-section of a process cartridge.
Figure 4:
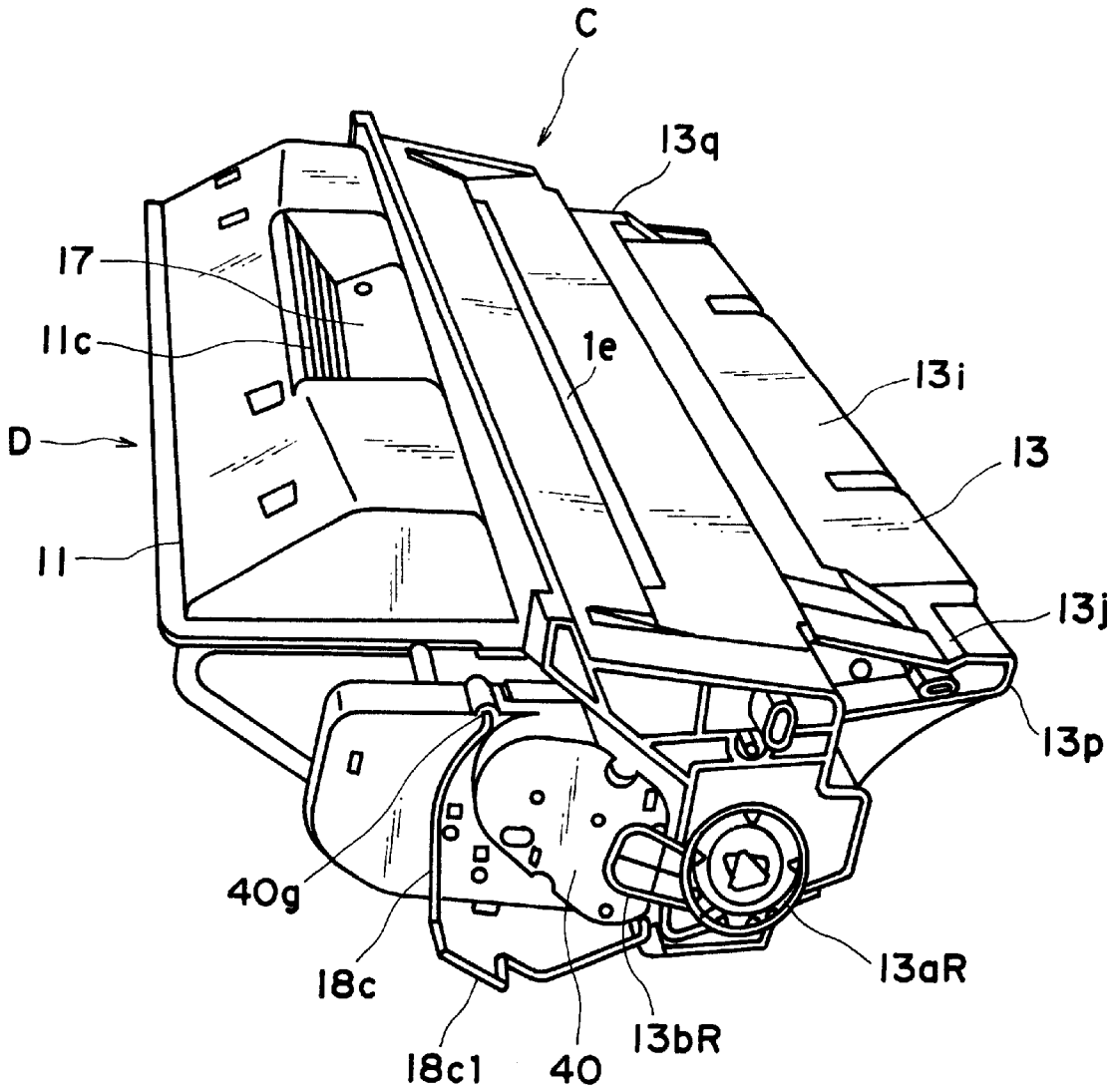
FIG. 4 is an external, perspective view of the process cartridge illustrated in FIG. 3, as seen from the top right direction.
Figure 5:
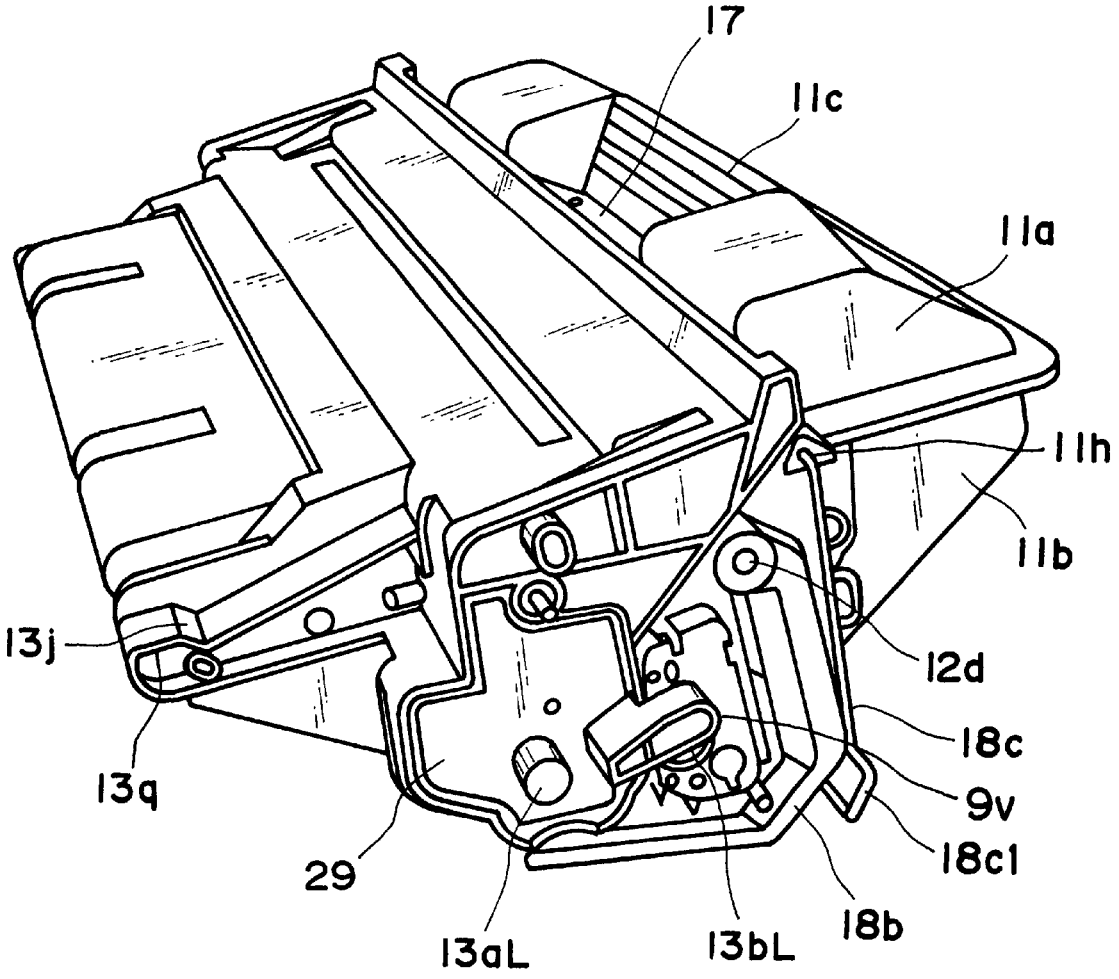
FIG. 5 is an external, perspective view of the process cartridge illustrated in FIG. 3, as seen from the top left direction.
Figure 6:
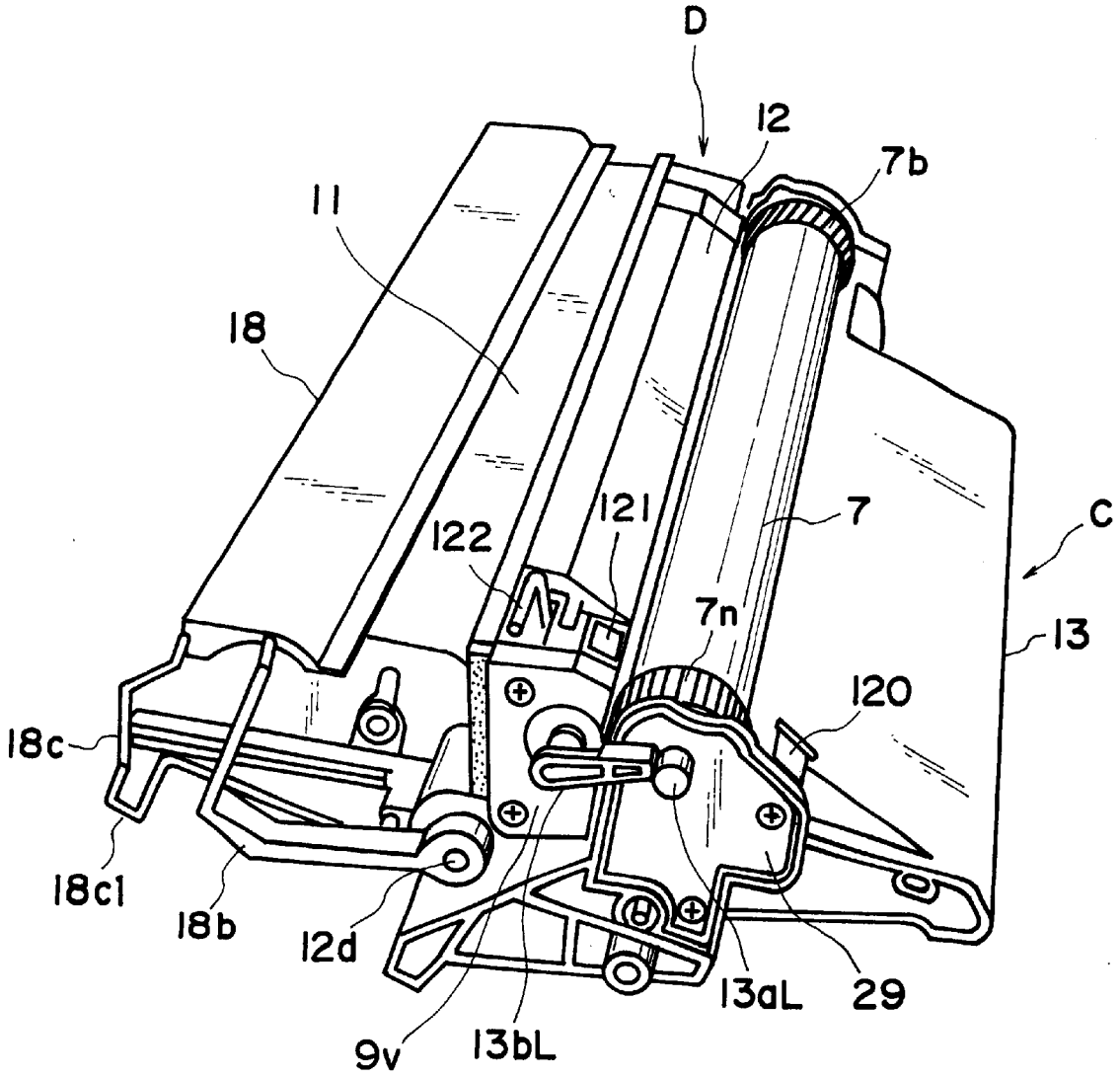
FIG. 6 is an external, perspective view of the bottom left side of the process cartridge illustrated in FIG. 3.

FIG. 1 is an electrophotographic image forming apparatus (laser beam printer) which embodies the present invention, depicting the general structure thereof; FIG. 2, an external, perspective thereof; and FIGS. 3 through 6 are drawings of process cartridges which embody the present invention. More specifically, FIG. 3 is a cross-section of a process cartridge; FIG. 4, an external, perspective view of the process cartridge; FIG. 5, a perspective view of the process cartridge as seen from the top left direction; and FIG. 6 is a perspective view of the process cartridge as seen from the bottom left direction. In the following description, the "top" surface of the process cartridge B means the surface which faces upward when the process cartridge B is in the main assembly 14 of the image forming apparatus, and the "bottom" surface means the surface which faces downward.

(Electrophotographic Image Forming Apparatus A and Process Cartridge B)

First, referring to FIGS. 1 and 2, a laser beam printer A as an electrophotographic image forming apparatus which embodies the present invention will be described. FIG. 3 is a cross-section of a process cartridge which also embodies the present invention.

Referring to FIG. 1, the laser beam printer A is an apparatus which forms an image on a recording medium (for example, recording sheet, OHP sheet, and fabric) through an electrophotographic image forming process. It forms a toner image on an electrophotographic photosensitive drum (hereinafter, photosensitive drum) in the form of a drum. More specifically, the photosensitive drum is charged with the use of a charging means, and a laser beam modulated with the image data of a target image is projected from an optical means onto the charged peripheral surface of the photosensitive drum, forming thereon a latent image in accordance with the image data. This latent image is developed into a toner image by a developing means. Meanwhile, a recording medium 2 placed in a sheet feeding cassette 3*a* is reversed and conveyed by a pickup roller 3*b,* a conveyer roller pairs 3*c* and 3*d,* and register roller pair 3*e,* in synchronism with the toner formation. Then, voltage is applied to an image transferring roller 4 as a means for transferring the toner image formed on the photosensitive drum 7 of the process cartridge B, whereby the toner image is transferred onto the recording medium 2. Thereafter, the recording medium 2, onto which the toner image has been transferred, is conveyed to a fixing means 5 by guiding conveyer 3*f.* The fixing means 5 has a driving roller 5*c,* and a fixing roller 5*b* containing a heater 5*a,* and applies heat and pressure to the recording medium 2 as the recording medium 2 is passed through the fixing means 5, so that the image having been transferred onto the recording medium 2 is fixed to the recording medium 2. Then, the recording medium 2 is conveyed farther, and is discharged into a delivery tray 6 through a reversing path 3*j,* by discharging roller pairs 3*q,* 3*h* and 3*i.* The delivery tray 6 is located at the top of the main assembly 14 of the image forming apparatus A. It should be noted here that a pivotable flapper 3*k* may be operated in coordination with a discharge roller pair 2*m* to discharge the recording medium 2 without passing it through the reversing path 3*j.* The pickup roller 3*b,* conveyer roller pairs 3*c* and 3*d,* register roller pair 3*e,* guiding conveyer 3*f,* discharge roller pairs 3*g,* 3*h* and 3*i,* and discharge roller pair 3*m* constitute a conveying means 3.

Referring to FIGS. 3 through 6, in the process cartridge B, on the other hand, the photosensitive drum 7 with a photosensitive layer is rotated to uniformly charge its surface by applying voltage to the charging roller 8 as a photosensitive drum charging means. Then, a laser beam modulated with the image data is projected onto the photosensitive drum 7 from the optical system 1 through an exposure opening 1*e,* forming a latent image on the photosensitive drum 7. The thus formed latent image is developed with the use of toner and the developing means 9. More specifically, the charging roller 8 is disposed in contact with the photosensitive drum 7 to charge the photosensitive drum 7. It is rotated by the rotation of the photosensitive drum 7. The developing means 9 provides the peripheral surface area (area to be developed) of the photosensitive drum 7 with toner so that the latent image formed on the photosensitive drum 7 is developed. The optical system 1 comprises a laser diode 1*a,* a polygon mirror 1*b,* a lens 1*c,* and a deflective mirror 1*d.*

In the developing means 9, the toner contained in a toner container 11A is delivered to an developing roller 9*c* by the rotation of a toner feeding member 9*b.* The developing roller 9*c* contains a stationary magnet 9*n.* It is also rotated so that a layer of toner with triboelectric charge is formed on the peripheral surface of the developing roller 9*c.* The image developing area of the photosensitive drum 7 is provided with the toner from this toner layer, the toner is transferred onto the peripheral surface of the photosensitive drum 7 in a manner to reflect the latent image, visualizing the latent image as a toner image. The developing blade 9*d* is a blade which regulates the amount of the toner adhered to the peripheral surface of the developing roller 9*c* and also triboelectrically charges the toner. Adjacent to the developing roller 9*c,* a toner stirring member 9*c* is rotatively disposed to circulatively stir the toner within the image developing chamber.

After the toner image formed on the photosensitive drum 7 is transferred onto the recording medium 2 by applying voltage with a polarity opposite to that of the toner image to the image transferring roller 4, the residual toner on the photosensitive drum 7 is removed by the cleaning means 10. The cleaning means 10 comprises an elastic cleaning blade 10*a* disposed in contact with the photosensitive drum 7, and the toner remaining on the photosensitive drum 7 is scraped off by the elastic cleaning blade 10*a,* being collected into a waste toner collector 10*b.*

The process cartridge B is formed in the following manner. First, a toner chamber frame 11 which comprises a toner container (toner storing portion) 11A for storing toner is joined with an image developing chamber frame (developer container) 12 which houses the image developing means 9 such as an image developing roller 9*c,* and then, a cleaning chamber frame 13, in which the photosensitive drum 7, the cleaning means 10 such as the cleaning blade 10*a,* and the charging roller 8 are mounted, is joined with the preceding two frames 11 and 12 to complete the process cartridge B. The thus formed process cartridge B is removably installable into the main assembly 14 of the image forming apparatus A.

The process cartridge B is provided with an exposure opening through which a light beam modulated with image data is projected onto the photosensitive drum 7, and a transfer opening 13*n* through which the photosensitive drum 7 opposes the recording medium 2. The exposure opening 1*e* is a part of the cleaning chamber frame 11, and the transfer opening 13*n* is located between the image developing chamber frame 12 and the cleaning chamber frame 13.

Next, the structure of the housing of the process cartridge B in this embodiment will be described.

The process cartridge in this embodiment is formed in the following manner. First the toner chamber frame 11 and the image developing chamber frame 12 are joined, and then, the cleaning chamber frame 13 is rotatively joined with the preceding two frames 11 and 12 to complete the housing. In this housing, the aforementioned photosensitive drum 7, charging roller 8, developing means 9, cleaning means 10, and the like, are mounted to complete the process cartridge B. The thus formed process cartridge B is removably installable into the cartridge accommodating means provided in the main assembly 14 of an image forming apparatus.

(Housing Structure of Process Cartridge B)

As described above, the housing of the process cartridge B in this embodiment is formed by joining the toner chamber frame 11, the image developing chamber frame 12, and the cleaning chamber frame 13. Next, the structure of the thus formed housing will be described.

Figure 9:
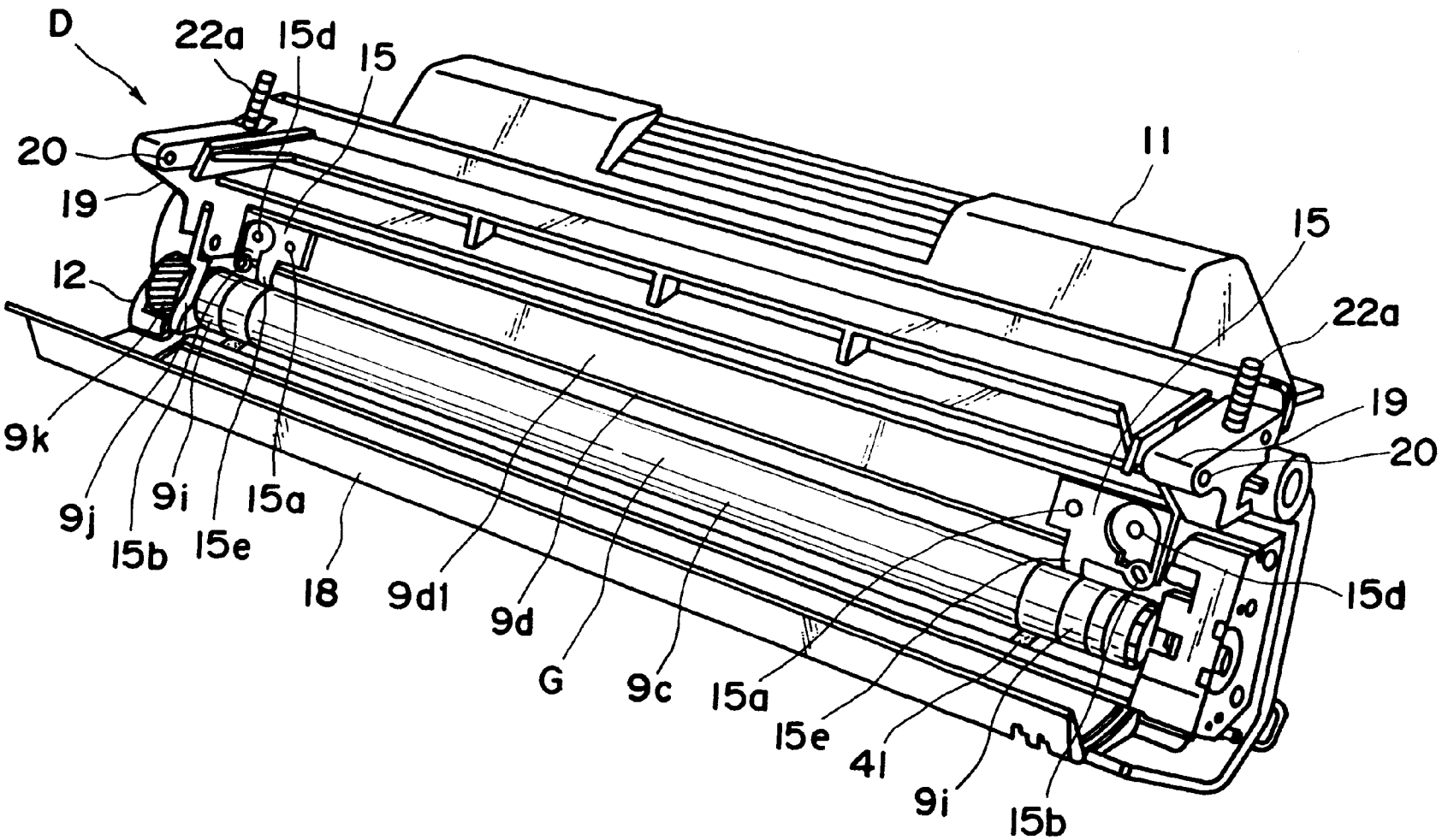
FIG. 9 is a perspective view of an image developing unit.

Referring to FIG. 3, in the toner chamber frame 11, the toner feeding member 9*b* is rotatively mounted. In the image developing chamber frame 12, the image developing roller 9*c* and the developing blade 9*d* are mounted, and adjacent to the developing roller 9*c*, the stirring member 9*c* is rotatively mounted to circulatively stir the toner within the image developing chamber. Referring to FIG. 3, in the image developing chamber frame 12, a rod antenna 9*h* is mounted, extending in the lengthwise direction of the developing roller 9*c* substantially in parallel to the developing roller 9*c*. The toner chamber frame 11 and the development chamber frame 12, which are equipped in the above-described manner, are welded together (in this embodiment, by ultrasonic wave) to form a second frame which constitutes an image developing unit D (FIG. 9).

The image developing unit D of the process cartridge B is provided with a drum shutter assembly 18, which covers the photosensitive drum 7 to prevent it from being exposed to light for an extend period of time or from coming in contact with foreign objects when or after the process cartridge B is removed from the main assembly 14 of an image forming apparatus.

Referring to FIG. 6, the drum shutter assembly 18 has a shutter cover 18*a* which covers or exposes the transfer opening 13*n* illustrated in FIG. 3, and linking members 18*b* and 18*c* which support the shutter cover 18. On the upstream side relative to the direction in which the recording medium 2 is conveyed, one end of the right-hand side linking member 18*c* is fitted in a hole 40*g* of a developing means gear holder 40 as shown in FIG. 4, and one end of the left-hand side linking member 18*c* is fitted in a boss 11*h* of the bottom portion 11*b* of the toner chamber frame 11, as shown in FIG. 5. The other ends of the left- and right-hand linking members 18*c* are attached to the corresponding lengthwise ends of the shutter cover 18*a*, on the upstream side relative to the recording medium conveying direction. The linking member 18*c* is made of a metallic rod. Actually, the left- and right-hand linking members 18*c* are connected through the shutter cover 18*a*; in other words, the left- and right-hand linking members 18*c* are the left- and right-hand ends of a single piece linking member 18*c*. The linking member 18*b* is provided only on one lengthwise end of the shutter cover 18*a*. One end of the linking member 18*b* is attached to the shutter cover 18*a*, on the downstream side, relative to the recording medium conveying direction, of the position at which the linking member 18*c* is attached to the shutter cover 18*a*, and the other end of the linking member 18*b* is fitted around a dowel 12*d* of the image development chamber frame 12. The linking member 18*b* is formed of synthetic resin.

The linking members 18*b* and 18*c*, which are different in length, form a four piece linkage structure in conjunction with the shutter cover 18*a* and the toner chamber frame 11. As the process cartridge B is inserted into an image forming apparatus, the portion 18*c*1 of the linking member 18*c*, which projects away from the process cartridge B, comes in contact with the stationary contact member (unillustrated) provided on the lateral wall of the cartridge accommodating space S of the mains assembly 14 of the image forming apparatus, and activates the drum shutter assembly 18 to open the shutter cover 18*a*.

The drum shutter assembly 18 constituted of the shutter cover 18*a* and the linking members 18*b* and 18*c* is loaded with the pressure from an unillustrated torsional coil spring fitted around a dowel 12*d*. One end of the spring is anchored to the linking member 18*b*, and the other end is anchored to the image developing chamber frame 12, so that the pressure is generated in the direction to cause the shutter cover 18*a* to cover the transfer opening 13*n*.

Referring again to FIG. 3, the cleaning means frame 13 is fitted with the photosensitive drum 7, the charging roller 8, and the various components of the cleaning means 10, to form a first frame as a cleaning unit C.

Then, the aforementioned image developing unit D and cleaning unit C are joined with the use of a joining member 22, in a mutually pivotable manner, to complete the process cartridge B. More specifically, referring to FIG. 9, both lengthwise (axial direction of the developing roller 9*c*) ends of the image developing chamber frame 12 are provided with an arm portion 19, which is provided with a round hole 20 which is in parallel to the developing roller 9*c*. On the other hand, a recessed portion for accommodating the arm portion 19 is provided at each lengthwise end of the cleaning chamber frame (unshown). The arm portion 19 is inserted in this recessed portion, and the joining member 22 is pressed into the mounting hole 13*e* of the cleaning chamber frame 13, put through the hole 20 of the end portion of the arm portion 19, and pressed, farther, into the hole 13*e* (FIG. 3) of an partitioning wall 13*t*, so that the image developing unit D and the cleaning unit C are joined to be pivotable relative to each other about the joining member 22. In joining the image developing unit D and the cleaning unit C, a compression type coil spring 22*a* is placed between the two units, with one end of the coil spring being fitted around an unillustrated dowel erected from the base portion of the arm portion 19, and the other end being pressed against the top wall of the recessed portion 21 of the cleaning chamber frame 13. As a result, the image developing chamber frame 12 is pressed downward to reliably keep the developing roller 9*c* pressed downward toward the photosensitive drum 7. More specifically, referring to FIG. 9, a roller 9*i* having a diameter larger than that of the developing roller 9*c* is attached to each lengthwise end of the developing roller 9*c*, and this roller 9*i* is pressed on the photosensitive drum 7 to maintain a predetermined gap (approximately 300 fm) between the photosensitive drum 7 and the developing roller 9*c*. The top surface of the recessed portion 21 of the cleaning chamber frame 13 is slanted so that the compression type coil spring 22*a* is gradually compressed when the image developing unit D and the cleaning unit C are united. That is, the image developing unit D and the cleaning unit C are pivotable toward each other about the joining member 22, wherein the positional relationship (gap) between the peripheral surface of the photosensitive drum 7 and the peripheral surface of the developing roller 9*c* is precisely maintained by the elastic force of the compression type coil spring 22*a*.

(Structure of Process Cartridge B Guiding Means)

Figure 7:
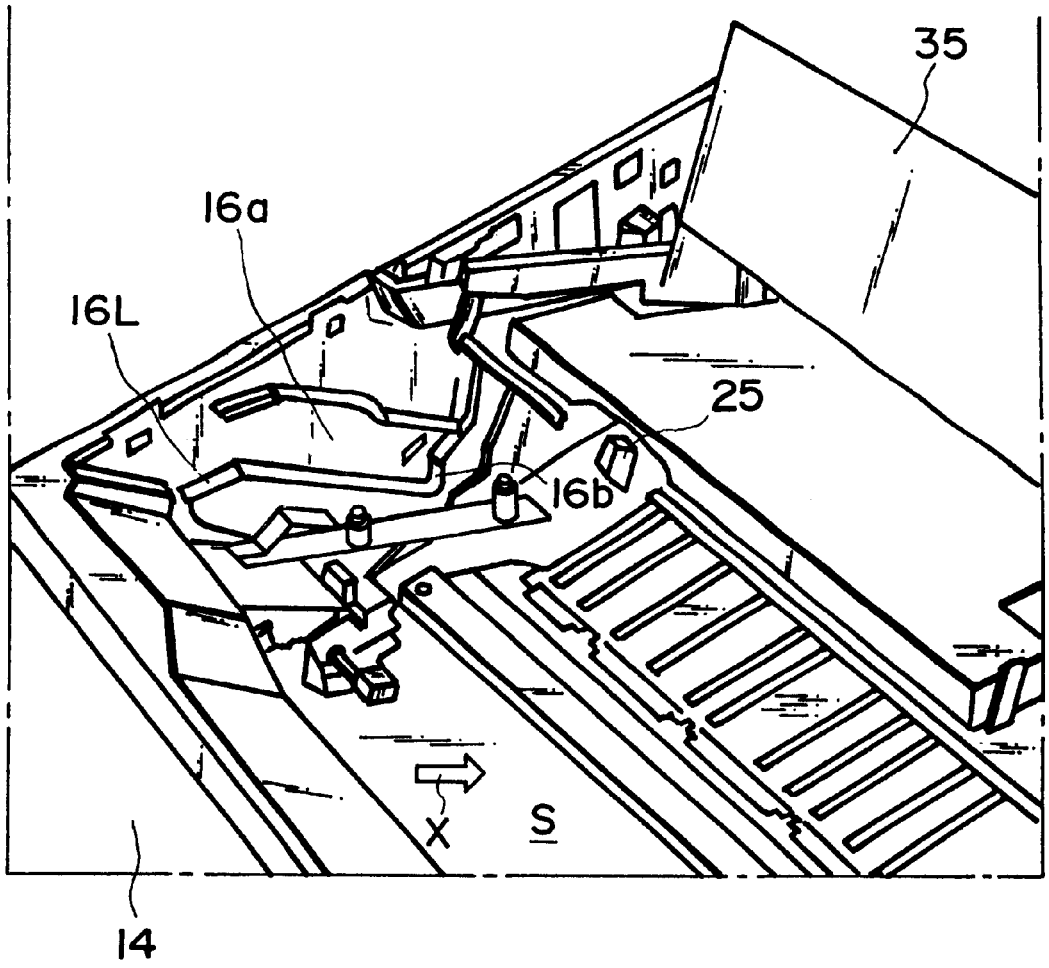
FIG. 7 is an external, perspective view of the process cartridge accommodating portion of the main assembly of the apparatus illustrated in FIG. 1.
Figure 8:
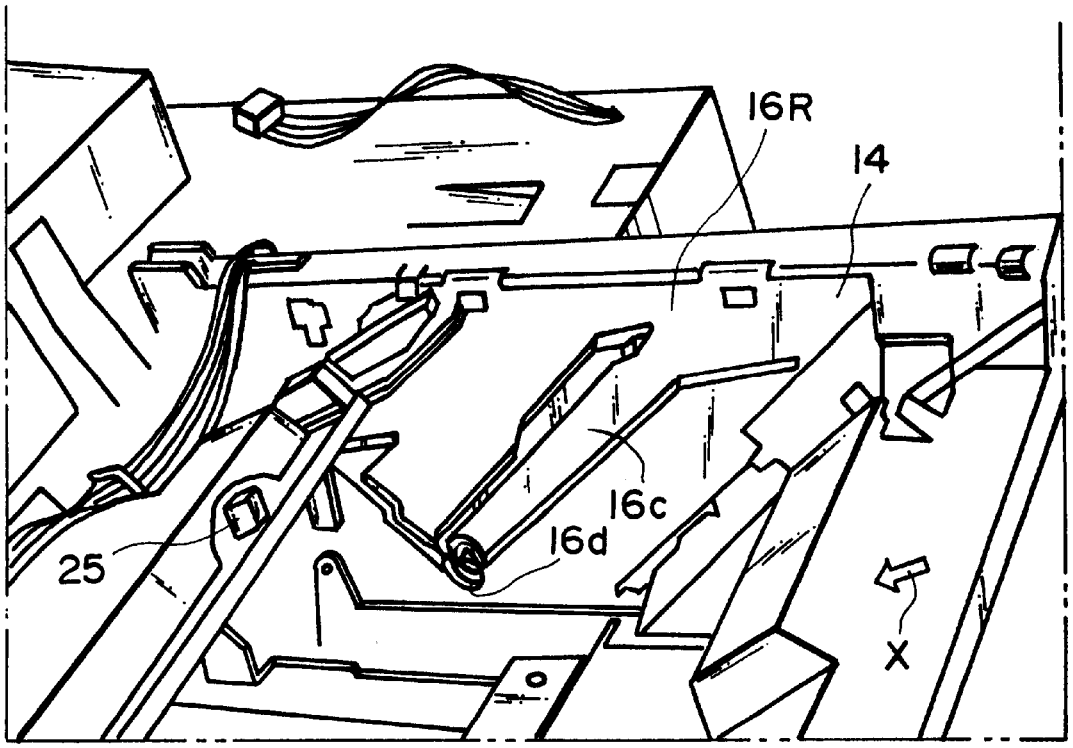
FIG. 8 is an external, perspective view of the process cartridge accommodating portion of the main assembly of the apparatus illustrated in FIG. 1.

Next, the means for guiding the process cartridge B when the process cartridge B is installed into, or removed from, the main assembly 14 of an image forming apparatus. This guiding means is illustrated in FIGS. 7 and 8. FIG. 7 is a perspective view of the left-hand side of the guiding means, as seen (in the direction of an arrow mark X) from the side from which the process cartridge B is installed into the main assembly 14 of the image forming apparatus A (as seen from the side of the image developing unit D side). FIG. 8 is a perspective view of the right-hand side of the same, as seen from the same side.

Referring to FIGS. 4, 5 and 6, each lengthwise end of the cleaning frame portion 13 is provided with means which serves as a guide when the process cartridge B is installed into, or removed from, the apparatus main assembly 14. This guiding means is constituted of a cylindrical guides 13*a*R and 13*a*L as a cartridge positioning guiding member, and rotation controlling guides 13*b*R and 13*b*L as means for controlling the attitude of the process cartridge B when the process cartridge B is installed or removed.

As illustrated in FIG. 4, the cylindrical guide 13*a*R is a hollow cylindrical member. The rotation controlling guides 13*b*R is integrally formed together with the cylindrical guide 13*a*R, and radially protrudes from the peripheral surface of the cylindrical guide 13*a*R. The cylindrical guide 13*a*R is provided with a mounting flange 13*a*R1 which is also integral with the cylindrical guide 13*a*R. Thus, the cylindrical guide 13*a*R, the rotation controlling guide 13*b*R, and the mounting flange 13*a*R1 constitute the right-hand side guiding member 13R, which is fixed to the cleaning chamber frame 13 with small screws put through the screw holes of the mounting flange 13*a*R1. With the right-hand side guiding member 13R being fixed to the cleaning chamber frame 13, the rotation controlling guide 13*b*R extends over the lateral wall of the developing means gear holder 40 fixed to the image developing chamber frame 12. As shown in FIG. 5, the generally flat flange 29 fixed on the cleaning frame 13 is provided with an outwardly projected cylindrical guide 13*a*L. The aforementioned stationary drum shaft 7*a* which rotatively supports a spur gear 7*n* fitted around the photosensitive drum 7 projects inwardly from the flange 29 (FIG. 6). The cylindrical guide 13*a*L and the drum shaft 7*a* are coaxial. The flange 29, the cylindrical guide 13*a*L, and the drum shaft 7*a*, are integrally formed of metallic material such as steel.

Referring to FIGS. 5 and 6, there is a rotation controlling guide 13*b*L slightly away from the cylindrical guide 13*a*L. It is long and narrow, extending substantially in the radial direction of the cylindrical guide 13*a*L and also projecting outward from the cleaning chamber frame 13. It is integrally formed with the cleaning chamber frame 13. In order to accommodate this rotation controlling guide 13*b*L, the flange 29 is provided with a cutaway portion. The distance the rotation controlling guide 13*b*L projects outward is such that its end surface is substantially even with the end surface of the cylindrical guide 13*a*L. The rotation controlling guide 13*b*L extends over the side wall of the developing roller bearing box 9*v* fixed to the image developing chamber frame 12. As is evident from the above description, the left-hand side guiding member 13L is constituted of separate two pieces: the metallic cylindrical guide 13*a*L and the rotation controlling guide 13*b*L of synthetic resin.

Next, a regulatory contact portion 13*j*, which is a part of the top surface of the cleaning chamber frame 13, will be described. In the following description of the regulatory contact portion 13*j*, "top surface" means the surface which faces upward when the process cartridge B is in the main assembly 14 of an image forming apparatus.

Referring to FIGS. 4 and 5, two portions 13*j* of the top surface 13*i* of the cleaning unit C, which are the portions right next to the right and left front corners 13*p* and 13*q*, relative to the direction perpendicular to the direction in which the process cartridge B is inserted, constitute the regulatory contact portions 13*j*, which regulate the position and attitude of the process cartridge B when the cartridge B is installed into the main assembly 14. In other words, when the process cartridge B is installed into the main assembly 14, the regulatory contact portion 13*j* comes in contact with the fixed contact member 25 provided in the main assembly 14 of an image forming apparatus (FIGS. 7 and 8), and regulates the rotation of the process cartridge B about the cylindrical guide 13*a*R and 13*a*L.

Next, the guiding means on the main assembly side 14 will be described. Referring to FIG. 1, as the lid 35 of the main assembly 14 of an image forming apparatus is pivotally opened about a supporting point 35*a* in the counterclockwise direction, the top portion of the main assembly 14 is exposed, and the process cartridge accommodating portion appears as illustrated in FIGS. 7 and 8. The left and right internal walls of the image forming apparatus main assembly 14, relative to the direction in which the process cartridge B is inserted, are provided with guide members 16L (FIG. 7) and 16R (FIG. 8), respectively, which extend diagonally downward from the side opposite to the supporting point 35*a*.

As shown in the drawings, the guide members 16L and 16R comprise guide portions 16*a* and 16*c*, and positioning grooves 16*b* and 16*d* connected to the guide portions 16*a* and 16*c*, respectively. The guide portions 16*a* and 16*c* extend diagonally downward, as seen from the direction indicated by an arrow mark X, that is, the direction in which the process cartridge B is inserted. The positioning grooves 16*b* and 16*d* have a semicircular cross-section which perfectly matches the cross-section of the cylindrical guides 13*a*L or 13*a*R of the process cartridge B. After the process cartridge B is completely installed in the apparatus main assembly 14, the centers of semicircular cross-sections of the positioning groove 16*b* and 16*d* coincide with the axial lines of the cylindrical guides 13*a*L and 13*a*R, respectively, of the process cartridge B, and hence, with the axial line of the photosensitive drum 7.

The width of the guide portions 16*a* and 16*c* as seen from the direction in which the process cartridge B is installed or removed is wide enough to allow the cylindrical guides 13*a*L and 13*a*R to ride on them with a reasonable amount of play. Therefore, the rotation controlling guides 13*b*L and 13*b*R which are narrower than the diameter of the cylindrical guide 13*a*L and 13*a*R naturally fit more loosely in the guide portions 16*a* and 16*c* than the cylindrical guides 13*a*L and 13*a*R , respectively, yet their rotation is controlled by the guide portions 16*a* and 16*c*. In other words, when the process cartridge B is installed, the angle of the process cartridge B is kept within a predetermined range. After the process cartridge B is installed in the image forming apparatus main assembly 14, the cylindrical guides 13*a*L and 13*a*R of the process cartridge B are in engagement with the positioning grooves 16*b* and 16*d* of the guiding members 13L and 13R, and the left and right regulatory contact portions 13*j* located at the front portion, relative to the cartridge inserting direction, of the cleaning chamber frame 13 of the process cartridge B, are in contact with the fixed positioning members 25, respectively.

In order to remove the process cartridge B from the apparatus main assembly 14, the above described steps are carried out in reverse. More specifically, first, the lid 35 of the apparatus main assembly 14 is opened, and the process cartridge B is pulled upward by grasping the top and bottom ribbed portions 11*c*, that is, the handhold portions, of the process cartridge by hand. Then, the cylindrical guides 13*a*L and 13*a*R of the process cartridge B rotate in the positioning grooves 16*b* and 16*d* of the apparatus main assembly 14. As a result, the regulatory contact portions 13*j* of the process cartridge B separate from the corresponding stationary positioning member 25. Next, the process cartridge B is pulled more. Then, the cylindrical guides 13*a*L and 13*a*R come out of the positioning grooves 16*b* and 16*d*, and move into the guide portions 16*a* and 16*c* of the guiding member 16L and 16R, respectively, fixed to the apparatus main assembly 14. In this condition, the process cartridge B is pulled more. Then, the cylindrical guides 13*a*L and 13*a*R and the rotation controlling guides 13*b*L and 13*b*R of the process cartridge B slide diagonally upward through the guide portions 16*a* and 16*c* of the apparatus main assembly 14, with the angle of the process cartridge B being controlled so that the process cartridge B can be completely moved out of the apparatus main assembly 14 without making contact with the portions other than the guide portions 16*a* and 16*c*.

Referring to FIG. 6, the spur gear 7*n* is fitted around one of the lengthwise ends of the photosensitive drum 7, which is the end opposite to where the helical drum gear 7*b* is fitted. As the process cartridge B is inserted into the apparatus main assembly 14, the spur gear 7*n* meshes with a gear (unillustrated) coaxial with the image transferring roller 4 located in the apparatus main assembly, and transmits from the process cartridge B to the transferring roller 4 the driving force which rotates the transferring roller 4.

(Toner Chamber Frame)

Figure 10:
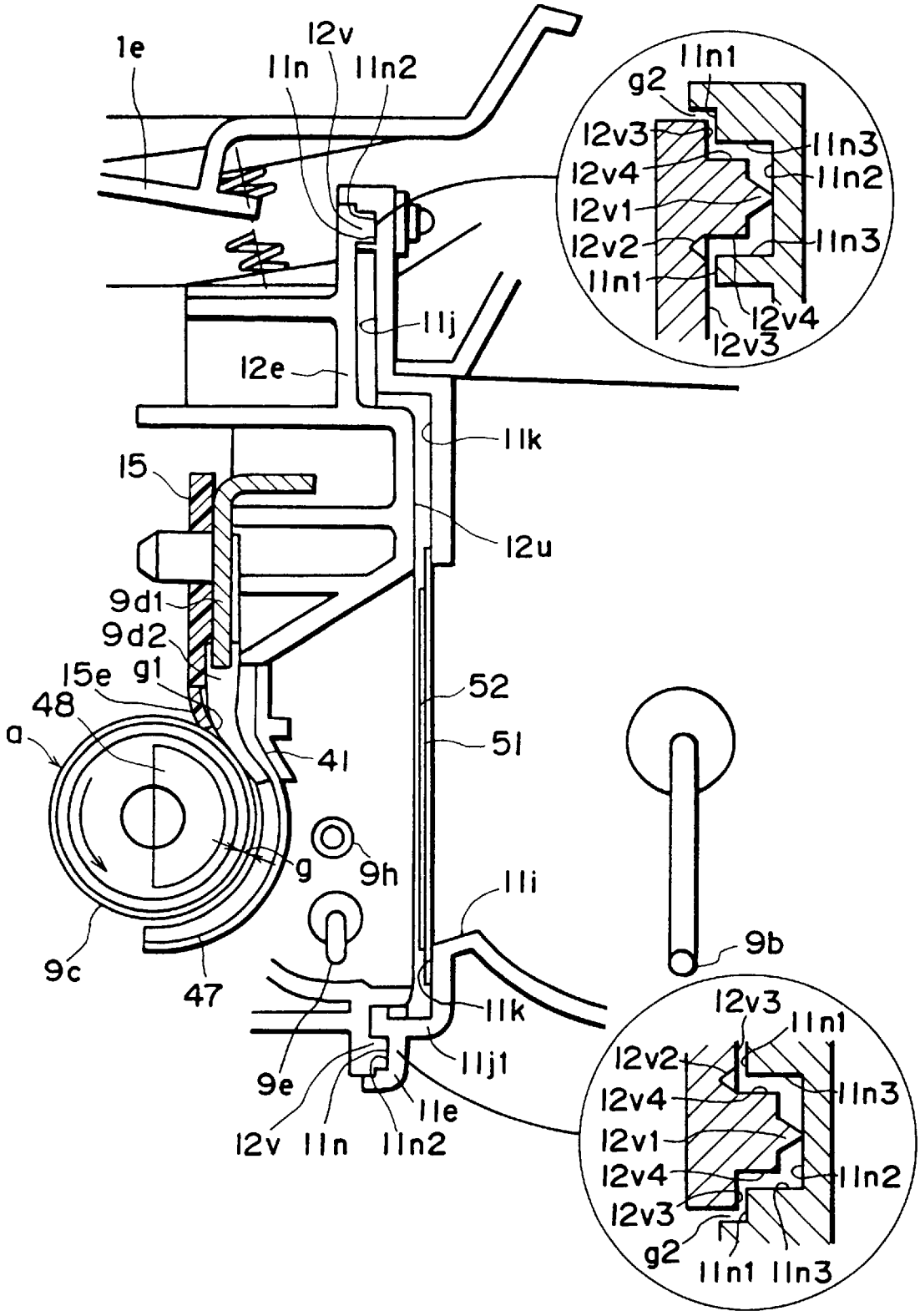
FIG. 10 is a longitudinal, sectional view of a part of a developing unit.

Referring to FIGS. 3 and 10, the toner chamber frame will be described in detail.

Referring to FIG. 3, the toner chamber frame 11 is constituted of two portions: the top and bottom portions 11*a* and 11*b*. Referring to FIG. 1, the top portion 11*a* bulges upward, occupying the space on the left-hand side of the optical system 1 in the image forming apparatus main assembly 14, so that the toner capacity of the process cartridge B can be increased without increasing the size of the image forming apparatus A. Referring to FIGS. 3, 4 and 5, the top portion 11*a* of the toner chamber frame 11 has a recessed portion 17, which is located at the lengthwise center portion of the top portion 11*a*, and serves as a handhold. An operator of the image forming apparatus can handle the process cartridge B by grasping it by the recessed portion 17 of the top portion 11*a* and the downward facing side of the bottom portion 11*b*. The ribs 11*c* extending on the downward facing surface of the bottom portion 11*b* in the lengthwise direction of the bottom portion 11*b* serve to prevent the process cartridge B from slipping out of the operator's hand. Referring again to FIG. 3, the flange 11*a*1 of the top portion 11*a* is aligned with the raised-edge flange 11*b*1 of the bottom portion 11*b*, the flange 11*a*1 being fitted within the raised edge of the flange 11*b*1 of the bottom portion 11*b*1, so that the walls of the top and bottom portions of the toner chamber frame 11 perfectly meet at the welding surface U, and then, the top and bottom portions 11*a* and 11*b* of the toner chamber frame 11 are welded together by melting the welding ribs with the application of ultrasonic waves. The method for uniting the top and bottom portions 11*a* and 11*b* of the toner chamber frame 11 does not need to be limited to ultrasonic welding.

Referring to FIGS. 3 and 10, the opening 11*i* through which toner is fed from the toner chamber frame section 11 into the development chamber frame section is located at the joint between the toner chamber frame section 11 and the development chamber frame section 12. The opening 11*i* is surrounded by an recessed surface 11*k* which in turn is surrounded by the top and bottom portions 11*j* and 11*j*1 of the flange of the toner chamber frame 11. The lengthwise outer (top) edge of the top portion 11*j* and the lengthwise outer (bottom) edge of the bottom portion 11*j*1 are provided with grooves 11*n*, respectively, which are parallel with each other. The top portion 11*j* of the flange above the recessed surface 11*k* is in the form of a gate, and the surface of the bottom portion 11*j*1 of the flange is perpendicular to the surface of the recessed surface 11*k*. Referring to FIG. 22, the plane of the bottom surface 11*n*2 of the groove 11*n* is on the outward side (toward the image developing chamber frame 12) of the surface of the recessed surface 11*k*.

Referring to FIG. 10, an alphanumeric reference 12*u* designates one of the flat surfaces of the image developing chamber frame 12, which faces the toner chamber frame 11. The flange 12*e* which is parallel with the flat surface 12*u* and surrounds all four edges of this flat surface 12*u* like a picture frame is provided at a level slightly recessed from the flat surface 12*u*. The lengthwise edges of the flange 12*e* are provided with a tongue 12*v* which fit into the groove 11*n* of the toner chamber frame 11. The top surface of the tongue 12*v* is provided with an angular ridge 12*v*1 for ultrasonic welding. After the various components are assembled into the toner chamber frame 11 and image developing chamber frame 12, the tongue of the image developing chamber frame 12 is fitted into the groove 11*n* of the toner chamber frame 11, and the two frames 11 and 12 are welded together along the tongue 12*v* and groove 11*n*.

Referring to FIG. 10, a cover film 51, which can be easily torn in the lengthwise direction of the process cartridge B, is pasted to the recessed surface 11*k* to seal the opening 11*i* of the toner chamber frame 11; it is pasted to the toner chamber frame 11, on the recessed surface 11*k*, alongside the four edges of the opening 11*i*. In order to unseal the opening 11*i* by tearing the cover film 51, the process cartridge B is provided with a tear tape 52, which is welded to the cover film 51. The cover tape 52 is doubled back from the lengthwise end 52*b* of the opening 11*i*, is put through between an elastic sealing member such as a piece of felt (not shown) and the opposing surface of the toner chamber frame 11, at the end opposite to the end 52*b*, and is slightly extended from the process cartridge B. The end portion 52*a* of the slightly sticking out tear tape 52 is adhered to a pull-tab 11*t* which is to be grasped by hand (not shown).

The material of the toner frame 11 and the developing device frame 12 may be plastic resin material such as polystyrene, ABS resin material, acrylonitrile/butadiene/styrene copolymer resin material, polycarbonate, polyethylene, polypropylene resin material or the like.

As shown in FIG. 9, a magnetic seal member 41 is disposed immediately inside (in the longitudinal direction) the spacer roller 9*i* at each of the opposite ends of the developing roller 9*c*. The magnetic seal member 41 is disposed with a predetermined clearance g from the outer surface of the developing roller 9*c*. It is mounted to the developing device frame 12. As shown in FIG. 10, a magnetic member 48 is disposed in the developing roller 9*c* at a position opposed to the magnetic seal member 41. A concentrated magnetic field is formed between the magnetic seal member 41 and the magnetic pole of the magnetic member 48 in the developing roller 9*c*. By doing so, a magnetic brush is formed with the toner in the gap g. As a result of the magnetic brush, the toner is prevented from leaking out of the developing zone. An end of a fixed magnet 9*n* is normally used as the magnetic member 48.

(Configuration of Magnetic Seal Member and Mounting Method Therefor)

Figure 13:
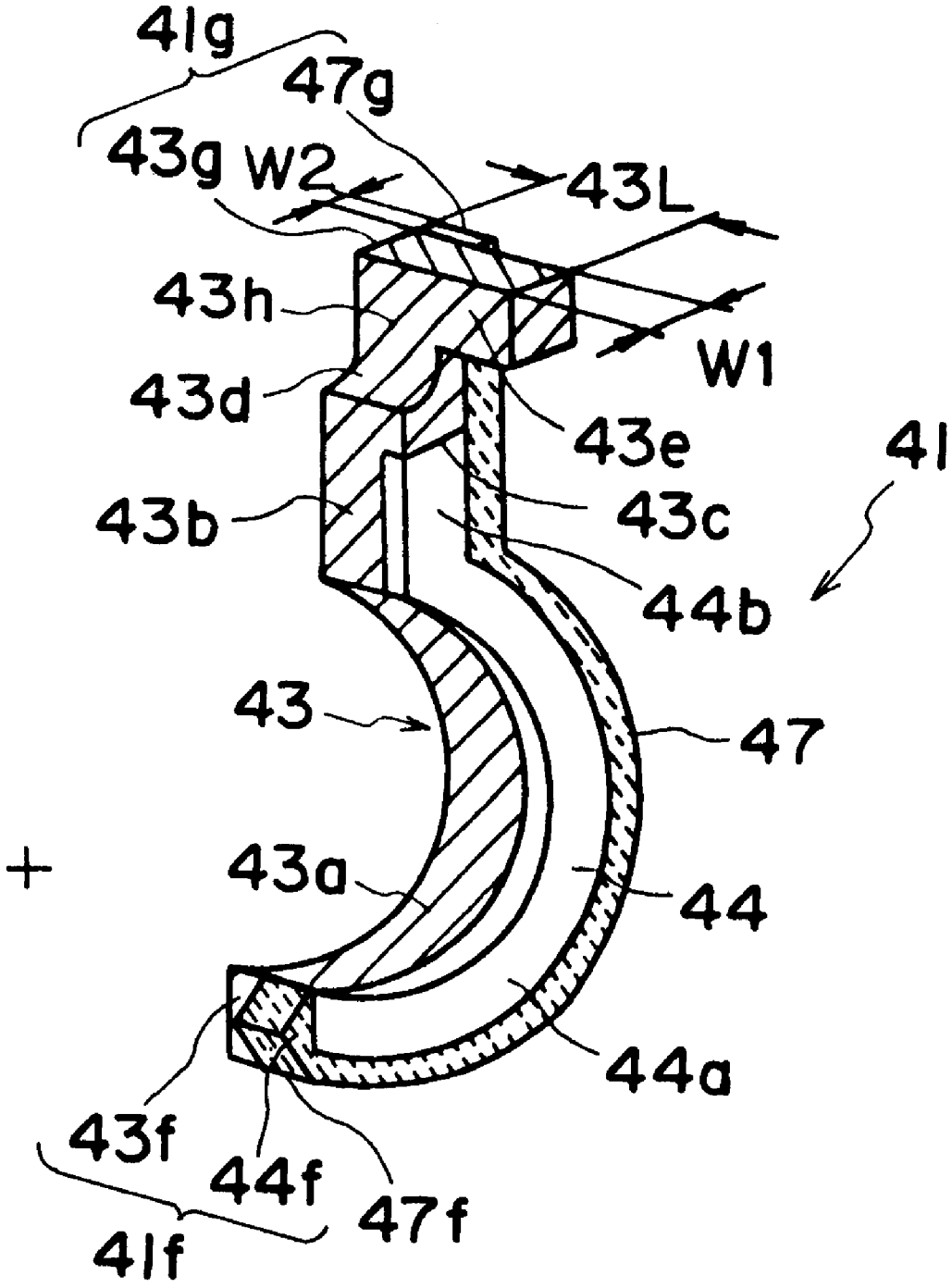
FIG. 13 is a perspective view of a magnetic seal member.
Figure 14:
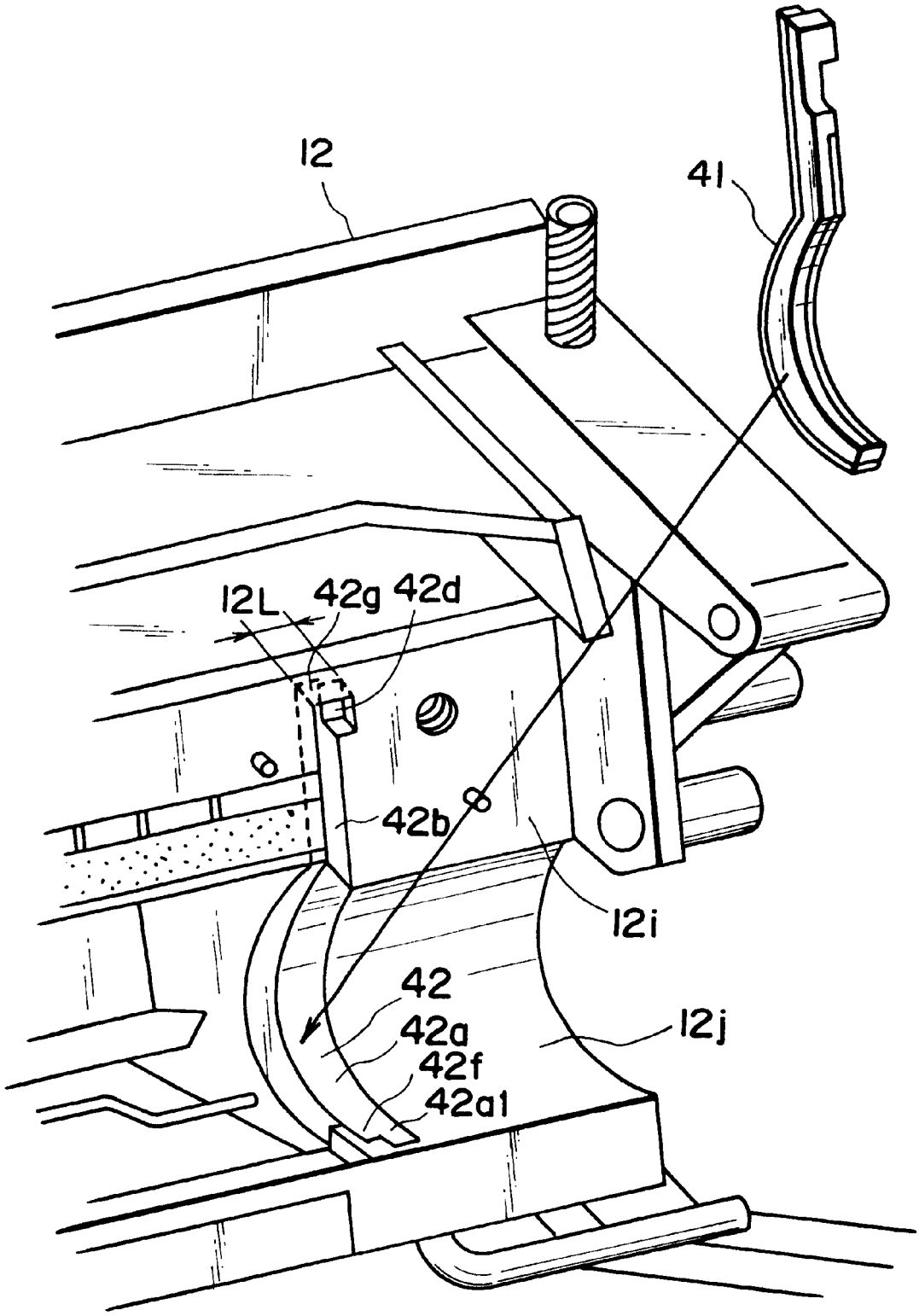
FIG. 14 is a perspective view of a mounting portion of a magnetic seal member.
Figure 15:
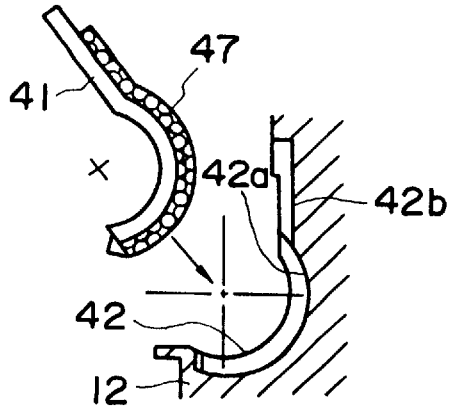
FIG. 15 is a side view illustrating mounting of a magnetic seal member.

FIGS. 13, 14 and 15 are perspective views showing the magnetic seal member 41 in detail.

The magnet 43 and the magnetic plate 44 have semicircular, arcuate portions 43*a*, 44*a* (semicircular, arcuate portions of the magnetic seal member 41) with a gap g1 from the developing roller 9*c* at the insides thereof. End surface portions 43*b*, 44*b* are extended upwardly from upper portions of the portions 43*a*, 44*a* respectively, offsetting toward the developing device frame 12 from the centers of the semicircular, arcuate portions 43*a*, 44*a*. The magnet 43 has a rectangular cross-section. A cross-section of a combination of the magnet 43 and the magnetic plate 44 is also rectangular. The top end of the magnetic plate 44 is contacted to a stepped portion 43*c* formed on the end surface portion 43*b* of the magnet 43. The end surface portions 43*b*, 44*b* of the magnet 43 and magnetic plate 44 are flush with each other in the side surface and the front surface at each side of the stepped portion 43*c*. Slightly above the stepped portion 43*c*, the magnet 43 is retracted from the arcuated surface 43*d*. Therefore, the magnet 43 is has a small width measured in the lateral direction. The retracted front side 43*h* and the bent portion 43*e* are bent to the longitudinal direction. The end surface portion 43*b* of the magnet 43 and the bent portion 43*e* form a right angle. The bent portion 43*c* is directed outward in the longitudinal direction.

The outer periphery sides (rear surface s) of the magnet 43 and the magnetic plate 44 are provided with elastic linings 47 of elastic material such as rubber. The elastic lining 47 has a longitudinal direction width which is substantially the same as that of the magnet 43 plus that of the magnetic plate 44. The lower end is projected from the bottom end surface 43*f* of the magnet 43 and from the bottom end surface 44*f* of the magnetic plate 44. The projected portion constitutes an end sealing portion 47*f*. The top end surface 47*g* of the lining is substantially flush with the top end surface 43*g* of the magnet 43.

The linings 47 are bonded on the rear surface and the lower end surface of the magnet 49 and the magnetic plate 44 by a double coated tape. Or, it is mounted thereto by vulcanization bonding.

Figure 16:
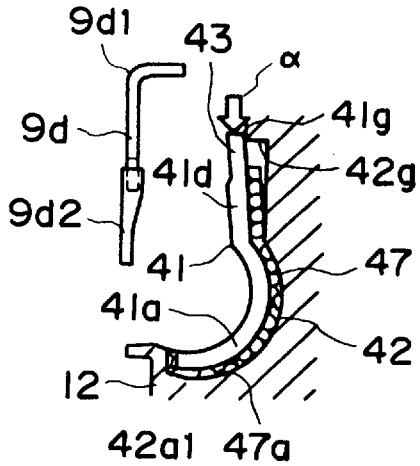
FIG. 16 is a side view illustrating mounting of a magnetic seal member.
Figure 17:
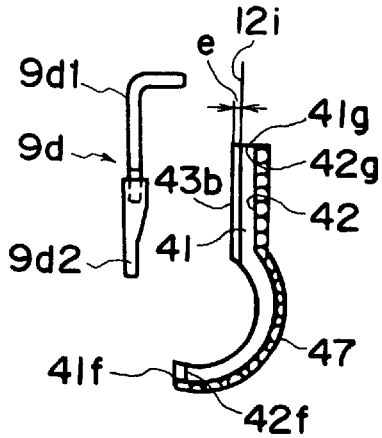
FIG. 17 is a side view illustrating mounting of a magnetic seal member.

As shown in FIG. 14, the developing device frame 12 is provided with a groove 42 for mounting a magnetic seal member 41, which groove extends from the flat surface 12*i* to the arcuated surface 12*j*. The groove 42 includes an arcuated groove 42*a* extended alone an arcuation of the arcuated surface 12*j*, a linear groove 42*b* extended along the flat surface 12*i*, and a positioning groove 42*d* with which the bent portion 43*e* of the magnetic seal member 41 is engaged. Here, the groove 42*b* is engaged with an end surface portion 43*b*. In the groove 42, the depth of the upper portion groove 42*d* and that of the groove 42*b*, are smaller than the width w1 of the bent portion plus the thickness of the lining 47 by a compression margin of the lining 47. The bottom end surface 42*f* of the groove 42*a* and the top end surface 42*g* are at a position where they are in contact with the bottom end surface 41*f* of the magnetic seal member 41 and with the top end surface 41*g*, when the magnetic seal member 41 is engaged with the groove 42. The bottom end of the groove 42 is provided with a positioning surface 41*f* for positioning by abutment to the bottom end surface 41*f*. Also provided is a sealing groove 42*a*1 in which the sealing portion 47*f* retracted from the surface 41*f* is received and is compressed. As shown in FIG. 15, the magnetic seal member 41 is engaged into the groove 42 as indicated by an arrow. As shown in FIG. 16, the portion 41*a* is fitted into the groove 42*a*. The end surface portion 41*b* is fitted into the groove 42*b*. When it is lightly pressed in the direction, the bottom lower portion 47*a* of the lining 47 is received by the groove 42*a*1 and is compressed. The bottom end surface 41*f* of the magnetic seal member 41 presses the bottom end surface 42*f* of the groove 42. Therefore, the top end surface 41*g* of the magnetic seal member 41 is flush with the top end surface 42*g* of the groove 42. When the operator pushes the upper portion of the magnetic seal member 41 toward the rear side in the direction crossing with the arrow, the magnetic seal member 41 is engaged with the groove 42 as shown in FIG. 17. In such a state, the front sides of the end surface portions 43*b*, 44*b*, is protruded beyond the flat surface 12*i* of the developing device frame 12 by an amount e (e is smaller in the lower portion of the end surface portion).

In such a state, the bottom end surface 41*f* and the top end surface 41*g* of the magnetic seal member 41 presses the bottom end surface 42*f* and the top end surface 42*g* of the groove 42, respectively, due to the elastic function of the lining 47. Thus, the seal member 41 is supported in the groove 42. The bottom end surface 47*f* of the lining 47 is urged to the wall of the groove 42*a*1.

In this manner, the operation of bring the magnetic seal member 41 into engagement with the groove 42, can be carried out independently. However, the process can be accomplished by modifying the next developing blade 9*d* mounting process.

In the state shown in FIG. 16, the developing blade 9*d* is moved to the right to contact it to the magnetic seal member 41. The plate 9*d*1 of the developing blade 9*d* is contacted to the front side of the magnetic seal member 41. The elastic blade 9*d*2 is contacted to the end surface portion 41*b*. Then, the plate 9*d*1 is lowered while urging it to the magnetic seal member 41. Accordingly, the plate 9*d*1 is brought into abutment with a corner portion between the top end surface portion 43*h* of the magnet 43 and the upper end surface 43*g*. Thus, the plate 9*d*1 urges the upper portion of the magnetic seal member 41 downwardly by frictional force. The sealing portion 47*f* of the lining 47 in the magnetic seal member 41 is compressed into the groove 42*a*1. The top end surface 41*g* is flush with the top end surface 42*g* of the groove 42. Therefore, the upper portion of the magnetic seal member 41 is engaged with the upper portion of the groove 42 by the force urging the developing blade 9*d*.

Figure 11:
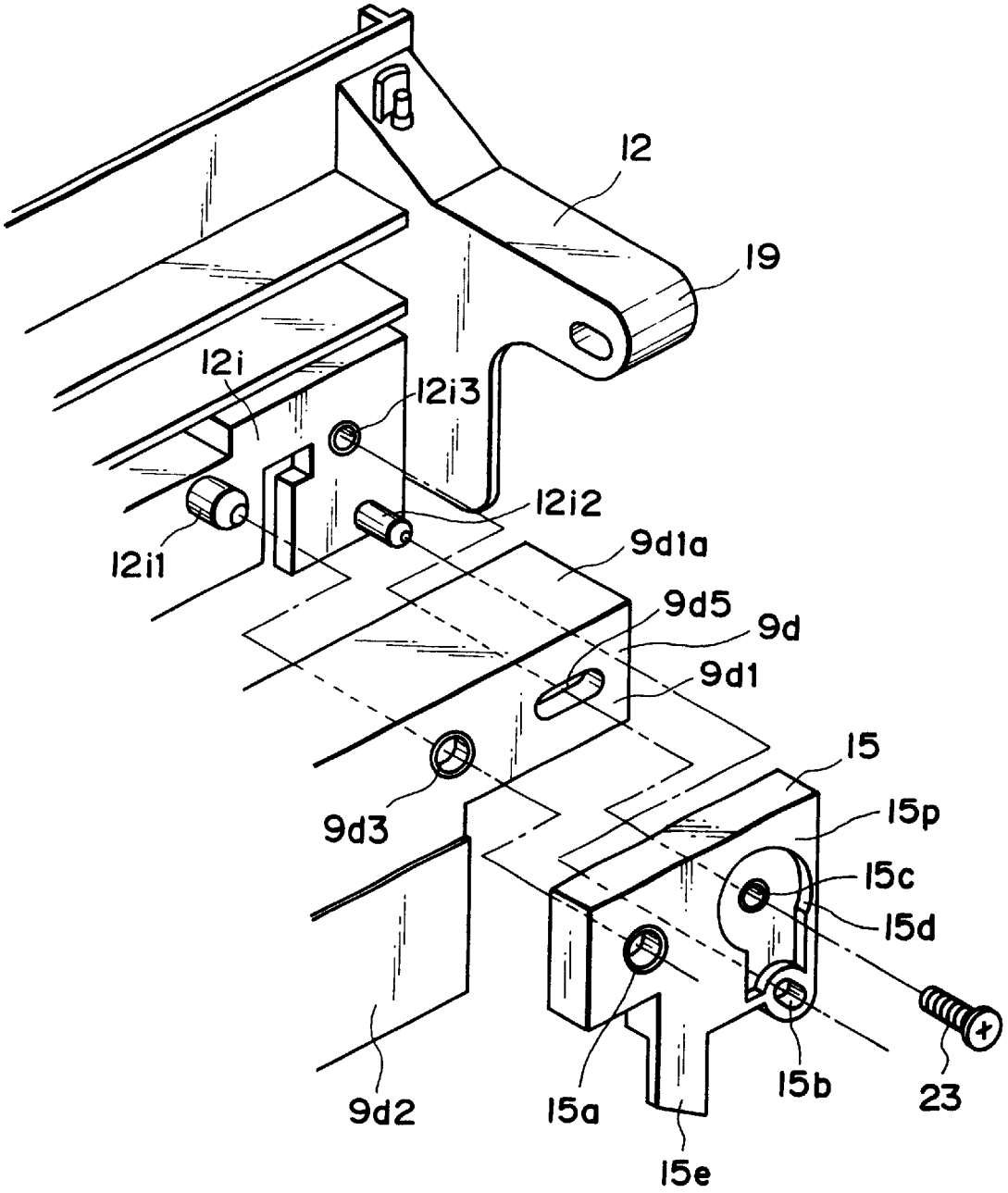
FIG. 11 is an exploded, perspective view (right-hand side) as seen from a front side of a developing device frame, illustrating a developing blade and a toner scraper member.
Figure 12:
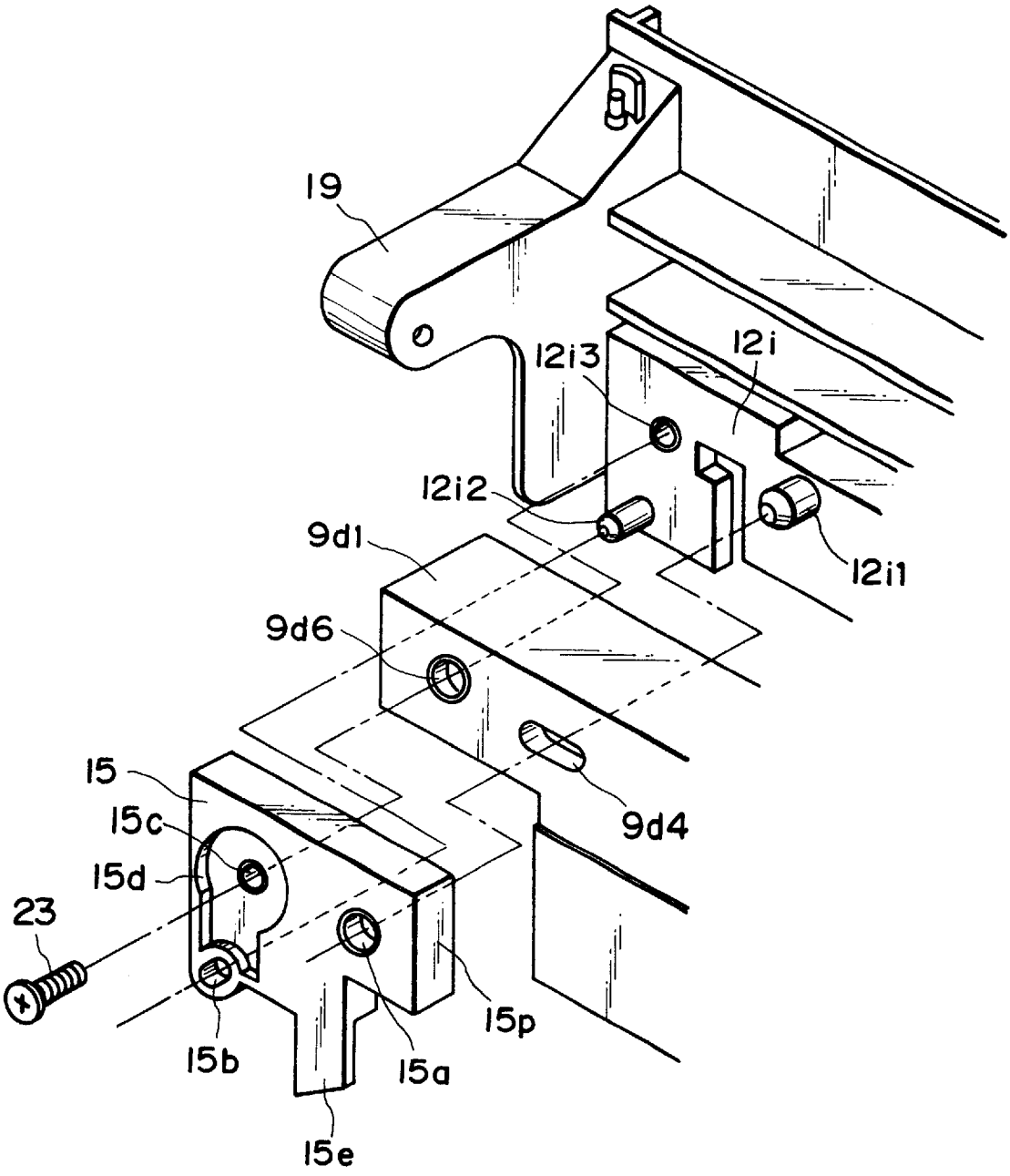
FIG. 12 is an exploded, perspective view (left side) as seen from a front side of a developing device frame, illustrating a developing blade and a toner scraper member.

Then, the developing blade 9*d* is mounted to the developing device frame 12. In the mounting, the round hole 9*d*3 and elongated hole 9*d*4 formed in the plate 9*d*1 of the developing blade 9*d* (FIGS. 11, 12) are fitted around the boss 12*i*1 of the developing device frame 12. Then, the toner scraper member 15 which will be described hereinafter is overlaid on the plate 9*d*1. Then they are fastened together with each other with the screw 23. By doing so, when the plate 9*d*1 of the developing blade 9*d* is closely contacted to the flat surface 12*i* of the developing device frame 12, the front side 43*h* of the magnet 43 is pressed by the plate 9*d*1 of the developing blade 9*d*. By this, the upper portion of the magnetic seal member 41 is pressed into the groove 42.

This rotates the upper portion of the magnetic seal member 41 into the groove 42 of the developing device frame 12 about the bottom end surface 41*f*. Thus, the lining 47 is compressed rearwardly. The reaction force thereof is received by the positioning surface 42*f* of the groove 42 to with the bottom end surface 41*f* of the magnetic seal member 41 is contacted and by the plate 9*d*1 to which the front side 43*h* portion is contacted.

Then, the developing roller unit G is mounted. This is shown in FIG. 9. By mounting the developing roller unit G, the elastic blade 9*d*2 of the developing blade 9*d* is bent. Therefore, the press-contact force of the plate 9*d*1 to the developing device frame 12 is increased. Thus, the mounting of the magnetic seal member 41 is made firm.

In this embodiment, the structure is described above. Therefore, the magnetic seal member 41 is held simply by engaging it into the groove 42. And, it is correctly mounted by urging the upper portion thereof by the plate 9*d*1. In this embodiment, the width w1 of the bent portion 43*e* of the magnet 43 in the lateral direction and the width of the groove 42*d* in which the bent portion 43*e* is engaged, are equal. Additionally, the length of 43L from an end of the base portion of the bent portion 43*e* to the free end is equal to the total length of 42L of the groove 42. By the plate 9*d*1, the bent portion 43*c* of the magnetic seal member 41 is confined so as to be engaged into the groove 42*d*. Therefore, the magnetic seal member 41 is correctly supported to the developing roller 9*c* in the perpendicular direction relative to the axis of the developing roller 9*c*.

The bottom end of the lining 47 is pressed into the groove 42*a*1. Therefore, the toner does not leak out through a small gap between the bottom end of the groove 42 and the bottom end of the magnetic seal member 41. The groove 42*a*1 has a width smaller than that of the groove 42. Therefore, the bottom end surface 42*f* of the groove 42 simultaneously satisfy the positioning of the bottom end of the magnetic seal member 41.

(Developing Blade and Toner Scraper Member)

The developing blade 9*d* is mounted to the developing device frame 12 after the magnetic seal member 41 is mounted. A toner scraper member 15 is mounted overlappingly to the developing blade 9*d*. The blade 9*d* and the toner scraper member 15 are fastened together.

The elastic blade 9*d*2 of the developing blade 9*d* is disposed between the magnetic seal members 41 provided at each of the opposite ends of the developing roller 9*c*. The opposite ends of the elastic blade 9*d*2 are substantially flush with the side surface of the magnet 43 of the magnetic seal member 41. The plate 9*d*1 for mounting the developing blade 9*d* is extended to the neighborhood of an opposing surface of the arm 19 at each side.

The developing blade 9*d* comprises a plate 9*d*1 having a thickness of 1–2 mm and an elastic blade 9*d*2 of urethane rubber or the like, mounted thereto by hot melt, double-coated adhesive tape, adhesive material or the like. By contacting the elastic blade 9*d*2 to the generating line of the developing roller 9*c*, the toner amount on the peripheral surface of the developing roller 9*c* is regulated. The material of the elastic blade 9*d*2 may be silicone rubber.

Bosses 12*i*1, 12*i*2 and screw 12*i*3 are formed at each of the opposite longitudinal end portions of the blade mounting surface 12*i* provided in the developing device frame 12. Here, the blade mounting portion 12*i* is a flat surface.

The heights of the bosses 12*i*1, 12*i*2 are larger than the thickness of the plate 9*d*1 of the developing blade 9*d*. More particularly, the Bosses 12*i*1, 12*i*2 are beveled at the free ends. Except for the beveled portion, the height from the blade mounting surface 12*i* is larger than the thickness of the plate 9*d*1 of the developing blade 9*d* plus the thickness of the toner scraper member.

The boss 12*i*1 corresponds to the neighborhood of the of the end portions of the elastic blade 9*d*2 in the range of the elastic blade 9*d*2. The boss 12*i*2 is positioned inclinedly below the boss 12*i*1 outwardly in the longitudinal direction. The position of the boss 12*i*2 corresponds to immediately inside of the longitudinal end portion of the plate 9*d*1, where there is not plate 9*d*1. The boss 12*i*2 is boss 12*i*2 in shape. The round hole 9*d*3 and the elongated hole 9*d*4 of the plate 9*d*1 are fitted around the boss 12*i*1. Then, the round hole 9*d*3 of the plate 9*d*1 is snugly fitted around the boss 12*i*1 provided adjacent one end of the developing device frame 12. Therefore, at one side of the developing blade 9*d*, the longitudinal and lateral (substantially vertical) positions are determined. The elongated hole 9*d*4 (elongated in the longitudinal direction of the plate 9*d*1) is fitted around the boss 12*i*1 provided adjacent the other end of the developing device frame 12. Therefore, the lateral position of the developing blade 9*d* is determined adjacent the other end. In this state, the positions of the elongated hole 9*d*5 of the plate 9*d*1 and the round hole 9*b*6 are aligned with the position of the screw 12*i*3 provided in the flat surface 12*i* of the developing device frame 12. The elongated hole 9*d*5 is long in the longitudinal direction of the plate 9*d*1.

The developing blade 9*d* is provided with a cut-away portion correspondingly to the boss 12*i*2 at each of the opposite ends. The bosses 12*i*1, 12*i*2 are fitted into the round hole 15*a* and the elongated hole 15*b* formed in the developer or toner scraper member 15. The elongated hole 15*b* is elongated in a direction connecting the bosses 12*i*1, 12*i*2. The toner scraper member 15 is provided with a hole 15*c* through which a screw is penetrated. The hole 15*c*, when the round hole 15*a* is engaged with the boss 12*i*1, and the elongated hole 15*b* is engaged with the boss 12*i*2, is aligned with the elongated hole 9*d*5 , round hole 9*b*6 and with a female screw bore 12*i*3 formed in the developing device frame 12. The hole 15*c* is formed at the center of a circular recessed seat 15*d*.

The toner scraper member 15, has a flat plate portion 15*p* which is thicker than the other portion and which is provided with the round hole 15*a*, the elongated hole 15*b* and the recessed seat 15*d*. The flat plate portion is cut at a corner of its generally rectangular shape to avoid interference with a corner of the elastic blade 9*d*2. The scraper member 15 is provided with a free end 15*e* which is elastically contacted to the developing roller 9*c* at a position substantially aligned with a magnetic seal member 41 which will be described hereinafter, in the longitudinal direction. The free end 15*e* is thin and is disposed at a front side of the plate portion 15*p*, i.e., the side of the developing blade 9*d* not contacted to the plate 8*d*1.

Figure 18:
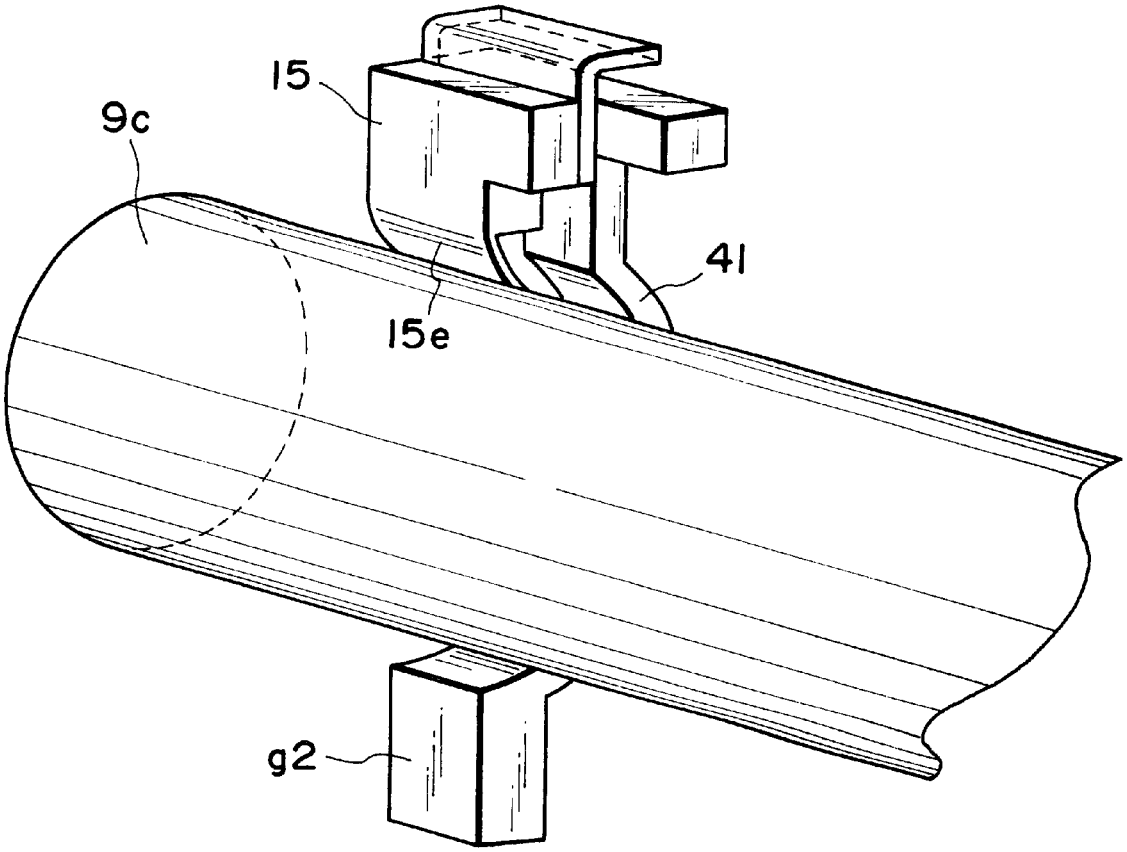
FIG. 18 is a schematic, perspective view of a toner scraper member.

As shown in FIG. 10, the toner scraper member 15 is disposed adjacent an outlet portion gl of the gap g of the magnetic seal upstream of a region a where the latent image on the photosensitive drum 7 is developed, with respect to a moving direction of the peripheral surface of the developing roller 9*c*. As described in the foregoing, the longitudinal position of the free end 15*e*, is the same as the magnetic seal member 41, as shown in FIG. 18. The free end 15*e* of the toner scraper member 15 is counterdirectionally contacted to the developing roller 9*c* with respect to the rotational direction of the developing roller 9*c*. The free end 15*e* is tapered so as to scrap the toner on the surface of the developing roller 9*c* longitudinally toward inside when the developing roller 9*c* is rotated. This is effective to prevent formation of a toner layer on the surface of the developing roller 9*c* opposed to the photosensitive drum 7 in the region of the magnetic seal. Therefore, the toner is prevented from stagnating at the inlet portion g2 of the gap g of the magnetic seal. Therefore, the magnetic force of the magnetic seal can be enhanced. The sealing property against the toner leakage is high even during manipulation by the user, and the durability is high.

The scraper member 15 is contacted to the surface of the developing roller 9*c*. However, since the contact area is small, the torque required for the rotation is not increased. Therefore, the use of the magnetic seal member 41 does not lessen the advantage of required torque reduction. The scraper member 15 is made by injection molding of synthetic resin material such as polyacetal, polycarbonate or the like resin material.

When the magnetic seal member 41 and the developing blade 9*d* are mounted to the developing device frame 12, the boss 12*i*1 is projection out of the round hole 9*d*3 and the elongated hole 9*d*4. The boss 12*i*2 is projected beyond the surface of the plate 9*d*1 in the cut away portion of the plate 9*d*1 at each of the end portions. The position of the elongated hole 9*d*5 at each of the opposite ends of the plate 9*d*1, is aligned with the position where the female screw 12*i*3 is formed in the flat surface of mounting the blade 12*i*. However, the magnetic seal member 41 and the developing blade 9*d* are not yet fixed on the developing device frame 12.

The round hole 15*a* of the toner scraper member 15 is fitted around the boss 12*i*1 of the developing device frame 12. Then, the elongated hole 15*b* is fitted around the boss 12*i*2 having two flats. Then, the hole 15*c* of the toner scraper member 15, the elongated hole 9*d*5 of the plate 9*d*1, and the female screw 12*i*3 in the flat surface 12*i* are aligned in a straight line.

Subsequently, a small screw 23 is threaded into the threaded hole 12*i*3 provided in the flat surface 12*i* through the hole 15*c* of the toner scraper member 15 and the elongated hole 9*d*5 of the plate 9*d*1. By this, the plate 9*d*1 presses against the upper end surface portion 43*h* of the magnetic seal member 41. By doing so, the elastic lining 47 of the magnetic seal member 41 is compressed. The magnetic seal member 41 is pressed into the groove 42. This press-contacts the plate 9*d*1 to the flat surface 12*i*. In addition, the toner scraper member 15 is press-contacted to the plate 9*d*1. Therefore, the developing blade 9*d* and the toner scraper member 15 are fixed to the developing device frame 12.

As described hereinbefore, the magnetic seal member 41 is engaged into the groove 42. The developing blade 9*d* is positioning relative to the boss 12*i*1. Furthermore, the toner scraper member 15 is engaged into the bosses 12*i*1, 12*i*2. The developing blade 9*d* and the toner scraper member 15 are fastened together by the screw 23. Thus, the developing blade and the toner scraper member are fixed by fastening them with two screws. The magnetic seal member is fixed by the groove. Therefore, the assembling process is simple.

The toner scraper member is positioned directly to the developing device frame. Therefore, the relative position thereof relative to the magnetic seal member which is positioning relative to the developing device frame is correct.

According to the embodiment, the developer scraper member is directly positioned relative to the developing container. The positioning of the developer scraper member is correct relative to the magnetic seal member and the developing roller.

The plate and the developer scraper member are positioned by the same positioning boss. Therefore, the positioning of the developer scraper member relative to the developing blade is further accurate.

The plate of the developing blade and the developer scraper member are fastened together. Therefore, the number of the screws used is smaller than when they are mounted separately. The time required for the assembling is short with a high assembling property.

The developer scraper member is provided at the outlet in the rotational direction of the developer carrying member, relative to the magnetic seal member. Therefore, the thin part may be short, and therefore, the mounting portion can be given a high rigidity. Thus, the free end portion is contacted to the developer carrying member with high stability.

The thin part is extended from the surface of the mounting portion. Therefore, a base portion of the thin part is at the position remote from the mounting surface of the developing blade by a distance which is the thickness of plate plus the mounting portion of the developer scraper member. Therefore, the thin part can be flexed toward the magnetic seal member.

The thin part is substantially at the same position as the magnetic seal member in the longitudinal direction of the developing roller. Therefore, the amount of the developer which is going around to the gap between the developing roller and the magnetic seal member, can be reduced.

The above-described structure was incorporated in a developing device or a process cartridge, and satisfactory results were confirmed.

As described in the foregoing, according to the present invention, the leakage of the developer can be assuredly prevented.

The process cartridge is a cartridge which is detachably mountable as a unit to a main assembly of an image forming apparatus and which contains as a unit an electrophotographic photosensitive member and developing means and charging means or cleaning means.

The process cartridge is a cartridge which is detachably mountable as a unit to a main assembly of an image forming apparatus and which contains as a unit an electrophotographic photosensitive member and developing means and at least one of developing means and cleaning means.

The process cartridge is a cartridge which is detachably mountable as a unit relative to a main assembly of an image forming apparatus and which contains as a unit an electrophotographic photosensitive member and developing means.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing a latent image formed on an electrophotographic photosensitive member, comprising:

a developing frame;

a developer carrying member for feeding a magnetic developer to develop a latent image formed on the electrophotographic photosensitive member with the developer, wherein a magnet is disposed in said developer carrying member;

a magnetic seal member provided at each of one and the other longitudinal ends of said developer carrying member with a clearance from a peripheral surface of said developer carrying member to prevent leakage of the developer in a longitudinal direction of said developer carrying member;

a developer regulating member provided contacted to the peripheral surface of said developer carrying member to prevent reentering of the developer having passed through a gap between said developer carrying member and said magnetic seal member, wherein said developer regulating member is disposed downstream of a position where the gap is provided in a rotational direction of said developer carrying member, and said developer regulating member is positioned relative to said developing frame, and wherein said developing frame is provided with a developer carrying member mounting portion for mounting said developer carrying member; and a developing blade for regulating an amount of the developer deposited on a peripheral surface of said developer carrying member, wherein said developing frame is provided with a positioning projection, and by fitting a hole in said developer regulating member around the projection, said developer regulating member is positioned relative to the developing frame.

2. An apparatus according to claim 1, wherein a hole provided in said developing blade is fitted around said projection, by which said developing blade is positioned relative to the developing frame.

3. An apparatus according to claim 2, wherein said magnetic seal member is provided in said developing frame and is sandwiched between said developing frame and said developing blade.

4. An apparatus according to claim 1, wherein said developer regulating member is injection-molded from a resin material.

5. An apparatus according to claim 1, wherein said developer regulating member is screwed on said developing frame.

6. A developing apparatus according to claim 1, wherein said developer regulating member is extended so as to contact a circumferential surface at the longitudinal end of said developer carrying member without contact thereto at a longitudinally central portion of said developer carrying member.

7. A developing apparatus according to claim 6, wherein said developer regulating member is provided with a portion for guiding the developer in a direction away from the longitudinal end to the central portion.

8. A developing apparatus according to claim 1, wherein said developing blade is substantially adjacent to said magnetic seal member in the longitudinal direction of said developer carrying member.

9. A process cartridge detachably mountable to a main assembly of an electrophotographic image forming apparatus, comprising:

an electrophotographic photosensitive member;

a developing frame;

a developing device including;

a developer carrying member for feeding a magnetic developer to develop a latent image formed on the electrophotographic photosensitive member with the developer, wherein a magnet is disposed in said developer carrying member;

a magnetic seal member provided at each of one and the other longitudinal ends of said developer carrying member with a clearance from a peripheral surface of said developer carrying member to prevent leakage of the developer in a longitudinal direction of said developer carrying member;

a developer regulating member provided contacted to the peripheral surface of said developer carrying member to prevent reentering of the developer having passed through a gap between said developer carrying member and said magnetic seal member, wherein said developer regulating member is disposed downstream of a position where the gap is provided in a rotational direction of said developer carrying member, and said developer regulating member is positioned relative to said developing frame, and wherein said developing frame is provided with a developer carrying member mounting portion for mounting said developer carrying member; and a developing blade for regulating an amount of the developer deposited on the peripheral surface of said developer carrying member, wherein said developing frame is provided with a positioning projection, and by fitting a hole in said developer regulating member around the projection, said developer regulating member is positioned relative to the developing frame.

10. A process cartridge according to claim 9, wherein a hole provided in said developing blade is fitted around said positioning projection, by which said developing blade is positioned relative to the developing frame.

11. A process cartridge according to claim 9, wherein said magnetic seal member is provided in said developing frame and is sandwiched between said developing frame and said developing blade.

12. A process cartridge according to claim 9, wherein said developer regulating member is injection-molded from a resin material.

13. A process cartridge according to claim 9 or 12, wherein said developer regulating member is screwed on a developing frame.

14. A process cartridge according to claim 9, further comprising a charging member for charging said electrophotographic photosensitive member.

15. A process cartridge according to claim 9 or 14, further comprising a cleaning member for removing a developer from said electrophotographic photosensitive member.

16. A developing apparatus comprising:

a developing frame;

a developer carrying member for carrying a developer to a developing zone where an electrostatic image formed on an image bearing member is developed by the developer, said developer carrying member being supported on said developing frame;

a sealing member having a sealing portion for sealing a longitudinal end of said developer carrying member to prevent leakage of the developer at the longitudinal end;

a developing blade for regulating a thickness of the developer on said developer carrying member; and a developer regulating member, disposed so as to contact a surface of said developer carrying member to prevent the developer having passed through the sealing portion on said developer carrying member from reentering the sealing portion;

wherein said developer regulating member is provided with a positioning portion which is positioned relative to said developing frame, wherein said positioning portion is in the form of a hole which is engaged with a projection provided in said developing frame.

17. A developing apparatus according to claim 16, wherein said developer regulating member is extended so as to contact a circumferential surface at the longitudinal end of said developer carrying member without contact thereto at a longitudinally central portion of said developer carrying member.

18. A developing apparatus according to claim 17, wherein said developer regulating member is provided with a portion for guiding the developer in a direction away from the longitudinal end to the central portion.

19. A developing apparatus according to claim 16, wherein said developing blade is substantially adjacent to said sealing member in a longitudinal direction of said developer carrying member.

20. A developing apparatus according to claim 16, wherein said developer regulating member is disposed downstream of said sealing portion and upstream of the developing zone with respect to a developer feeding direction of said developer carrying member.

21. A developing apparatus according to claim 16, wherein said developing apparatus and said image bearing member constitute a process cartridge detachably mountable to a main assembly of an image forming apparatus.

22. A developing apparatus according to claim 16, wherein said sealing member is opposed to a peripheral surface of said developer carrying member with a gap in which a magnetic brush is formed.

23. An apparatus according to claim 16, wherein said developing blade is positioned relative to said developing frame by said projection being engaged with a hole formed in said developing blade.

24. A developing apparatus comprising:

a developing frame;

a developer carrying member for carrying a developer to a developing zone where an electrostatic image formed on an image bearing member is developed by the developer, said developer carrying member being supported on said developing frame;

a sealing member having a sealing portion for sealing a longitudinal end of said developer carrying member to prevent leakage of the developer at the longitudinal end;

a developing blade for regulating a thickness of the developer on said developer carrying member; and a developer regulating member, disposed so as to contact a surface of said developer carrying member to prevent the developer having passed through the sealing portion on said developer carrying member from reentering the sealing portion, where said developing frame is provided with a common positioning portion for positioning said developer regulating member and said developing blade relative to said developing frame.

25. An apparatus according to claim 24, wherein said developer regulating member is extended so as to contact a circumferential surface at the longitudinal end of said developer carrying member without contact thereto at a longitudinally central portion of said developer carrying member.

26. An apparatus according to claim 25, wherein said developer regulating member is provided with a portion for guiding the developer in a direction away from the longitudinal end to the central portion.

27. An apparatus according to claim 24, wherein said developing blade is substantially adjacent to said sealing member in a longitudinal direction of said developer carrying member.

28. An apparatus according to claim 24, wherein said developer regulating member is disposed downstream of said sealing portion and upstream of the developing zone with respect to a developer feeding direction of said developer carrying member.

29. An apparatus according to claim 24, wherein said developing apparatus and said image bearing member constitute a process cartridge detachably mountable to a main assembly of an image forming apparatus.

30. An apparatus according to claim 24, wherein said sealing member is opposed to a peripheral surface of said developer carrying member with a gap in which a magnetic brush is formed.

31. An apparatus according to claim 24, wherein said positioning portion is in the form of a projection which is engageable with a hole provided in said developer regulating member and a hole provided in said developing blade.

32. An apparatus according to claim 24, wherein said blade includes an elastic blade and a supporting member for supporting the elastic blade, and said supporting member is positioned by said positioning portion.

* * * * *

UNITED STATES PATENT AND TRADEMARK OFFICE

CERTIFICATE OF CORRECTION

PATENT NO. : 6,266,500 B1
DATED : July 24, 2001
INVENTOR(S) : Atsushi Numagami

It is certified that error appears in the above-identified patent and that said Letters Patent is hereby corrected as shown below:

Title page,
Item [54], Title, "DEVELOPING APPARATUS AND PROCESS CARTRIDGE" should read -- DEVELOPING APPARATUS WITH SEALING MEMBER AND DEVELOPER REGULATING MEMBER FEATURES AND PROCESS CARTRIDGE EMPLOYING THE SAME --.

Column 1,
Line 42, "proposed" should read -- proposed that --.
Line 53, "rotated" should read -- rotated at --.

Column 5,
Line 46, "extend" should read -- extended --.

Column 9,
Line 11, "above described" should read -- above-described --.

Column 11,
Line 35, "is" should be deleted.
Line 60, "alone" should read -- along --.

Column 12,
Line 36, "of bring" should read -- brings --.

Column 14,
Line 6, "of" (2nd occurrence) should be deleted.
Line 7, "the" (1st occurrence) should be deleted.
Line 39, "9d5 ," should read -- 9d5, --.
Line 55, "8d1." should read -- 9d1. --.

Column 15,
Line 20, "projection" should read -- projected --.
Line 51, "positioning" should read -- positioned --.

UNITED STATES PATENT AND TRADEMARK OFFICE

CERTIFICATE OF CORRECTION

PATENT NO. : 6,266,500 B1
DATED : July 24, 2001
INVENTOR(S) : Atsushi Numagami

It is certified that error appears in the above-identified patent and that said Letters Patent is hereby corrected as shown below:

Column 17,
Line 57, “including;” should read -- including: --.

Signed and Sealed this

Twenty-second Day of October, 2002

*Attest:*

*Attesting Officer*

JAMES E. ROGAN
*Director of the United States Patent and Trademark Office*